US011297985B2

(12) United States Patent
Thorne et al.

(10) Patent No.: US 11,297,985 B2
(45) Date of Patent: Apr. 12, 2022

(54) MULTI-MODE CLEANING APPARATUS WITH SUCTION

(71) Applicant: SharkNinja Operating, LLC, Needham, MA (US)

(72) Inventors: Jason B. Thorne, Dover, MA (US); Gao Wenxiu, Suzhou (CN); Peter Hutchinson, Suzhou (CN)

(73) Assignee: SharkNinja Operating LLC, Needham, MA (US)

( * ) Notice: Subject to any disclaimer, the term of this patent is extended or adjusted under 35 U.S.C. 154(b) by 454 days.

(21) Appl. No.: 16/346,794

(22) PCT Filed: Nov. 1, 2017

(86) PCT No.: PCT/US2017/059479
§ 371 (c)(1),
(2) Date: May 1, 2019

(87) PCT Pub. No.: WO2018/085356
PCT Pub. Date: May 11, 2018

(65) Prior Publication Data

US 2019/0274500 A1 Sep. 12, 2019

Related U.S. Application Data

(60) Provisional application No. 62/415,716, filed on Nov. 1, 2016.

(51) Int. Cl.
*A47L 5/30* (2006.01)
*A47L 9/04* (2006.01)
(Continued)

(52) U.S. Cl.
CPC ..... *A47L 5/30* (2013.01); *A47L 5/12* (2013.01); *A47L 5/24* (2013.01); *A47L 5/28* (2013.01);
(Continued)

(58) Field of Classification Search
CPC ..... A47L 5/30; A47L 5/12; A47L 5/24; A47L 5/28; A47L 7/02; A47L 9/0477; A47L 9/10; A47L 9/1409; A47L 11/22
See application file for complete search history.

(56) References Cited

U.S. PATENT DOCUMENTS 2,538,464 A 1/1951 Macfarland
6,006,401 A 12/1999 Jailor et al.
(Continued)

FOREIGN PATENT DOCUMENTS

CN 102188215 9/2011
CN 203987865 12/2014
(Continued)

OTHER PUBLICATIONS

Chinese Office Action with English translation dated Apr. 23, 2021, received in Chinese Patent Application No. 201780067666.0, 14 pages.
(Continued)

*Primary Examiner* — David Redding
(74) *Attorney, Agent, or Firm* — Grossman Tucker Perreault & Pfleger, PLLC

(57) ABSTRACT

A multi-mode cleaning apparatus with suction may include a wand with a handle, a suction motor for providing suction, a bare floor unit configured to be movable by the wand and fluidly coupled to the suction motor, and a sweeper unit configured to be movable by the wand and fluidly coupled to the suction motor. The bare floor unit is configured for use in a suction only mode. The sweeper unit includes a rotatable brush roll and is configured for use in a brush roll only mode or a suction and brush roll mode.

22 Claims, 27 Drawing Sheets

(51) Int. Cl.

| | |
|---|---|
| ***A47L 11/22*** | (2006.01) |
| ***A47L 5/12*** | (2006.01) |
| ***A47L 9/10*** | (2006.01) |
| ***A47L 5/28*** | (2006.01) |
| ***A47L 9/14*** | (2006.01) |
| ***A47L 7/02*** | (2006.01) |
| ***A47L 5/24*** | (2006.01) |

(52) U.S. Cl.

CPC ..... *A47L 7/02* (2013.01); *A47L 9/0477* (2013.01); *A47L 9/10* (2013.01); *A47L 9/1409* (2013.01); *A47L 11/22* (2013.01)

(56) References Cited

U.S. PATENT DOCUMENTS

| | | | |
|---|---|---|---|
| 7,210,196 | B2 | 5/2007 | Shanor et al. |
| 7,694,383 | B2 | 4/2010 | Zahuranec et al. |
| 8,424,151 | B2 | 4/2013 | Lee |
| 8,499,398 | B2 | 8/2013 | Reese et al. |
| 2002/0059689 | A1 | 5/2002 | Kato et al. |
| 2010/0170059 | A1 | 7/2010 | Vrdoljak |
| 2010/0205768 | A1 | 8/2010 | Oh |
| 2016/0220080 | A1 | 8/2016 | Thorne |

FOREIGN PATENT DOCUMENTS

| | | | |
|---|---|---|---|
| WO | 2007059355 | A1 | 5/2007 |
| WO | 2012085567 | A1 | 6/2012 |

OTHER PUBLICATIONS

UK Office Action dated Jun. 30, 2021, received in UK Patent Application No. GB1906944.2, 2 pages.

PCT Search Report and Written Opinion dated Jan. 26, 2018 Received in PCT/US17/59479, 10 pgs.

Chinese Office Action with English translation dated Sep. 16, 2020, received in Chinese Patent Application No. 201780067666.0, 11 pages.

MULTI-MODE CLEANING APPARATUS WITH SUCTION

CROSS-REFERENCE TO RELATED APPLICATIONS

The present disclosure claims the benefit of U.S. Provisional Patent Application Ser. No. 62/415,716 filed Nov. 1, 2016, which is fully incorporated herein by reference.

TECHNICAL FIELD

The present invention relates to a cleaning apparatus and more particularly, to a multi-mode cleaning apparatus.

BACKGROUND INFORMATION

A sweeper-type surface cleaning apparatus generally uses a rotating brush roll to cause debris to be lifted from a surface and collected in a receptacle. This type of apparatus is often designed to be relatively light-weight, low power and cordless. As such, a sweeper-type surface cleaning apparatus usually does not use suction similar to a vacuum cleaner and thus may be limited to certain cleaning applications.

BRIEF DESCRIPTION OF THE DRAWINGS

These and other features and advantages will be better understood by reading the following detailed description, taken together with the drawings wherein.

DETAILED DESCRIPTION

A multi-mode cleaning apparatus (also generally referred to as a multi-mode sweeping apparatus), consistent with embodiments of the present disclosure, uses suction and provides multiple cleaning modes for different cleaning applications (e.g., bare floor or carpet). The multi-mode cleaning apparatus generally includes a wand and different cleaning heads or units configured for different modes for collecting debris from a surface to be cleaned. At least one of the cleaning heads or units includes a receptacle or dust cup for retaining debris that has been collected. The different modes may include, for example, a suction only mode where only suction is used to collect debris, a brush roll only mode where only a rotating brush roll is used to collect debris, and a suction and brush roll mode where both suction and a brush roll are used to collect debris. Various embodiments are illustrated and described herein as examples of a multi-mode cleaning apparatus using suction.

Figure 1A:
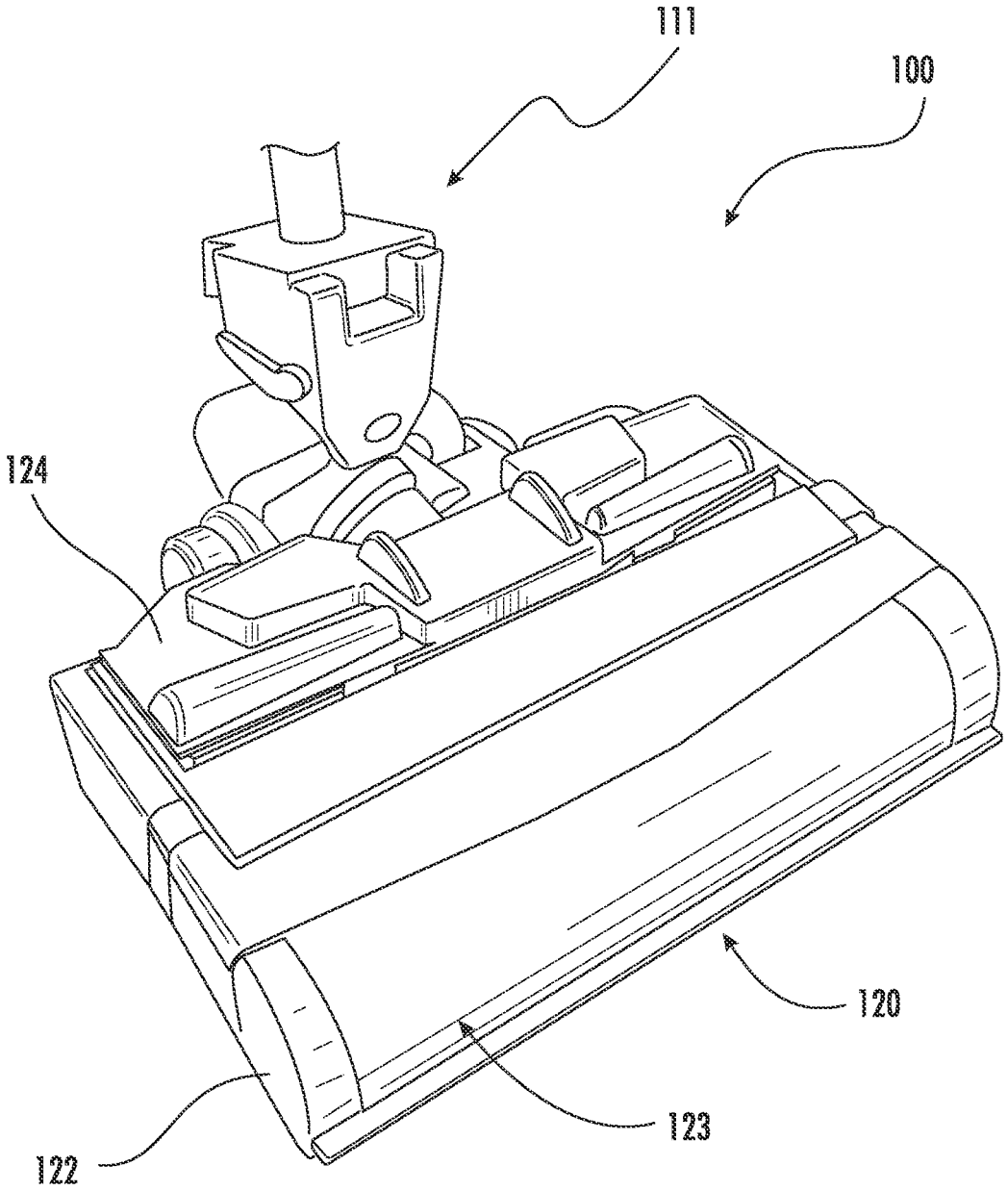
FIG. 1A is a perspective view generally illustrating one embodiment of a multi-mode cleaning apparatus with suction and sweeping, consistent with an embodiment of the present disclosure.
Figure 1B:
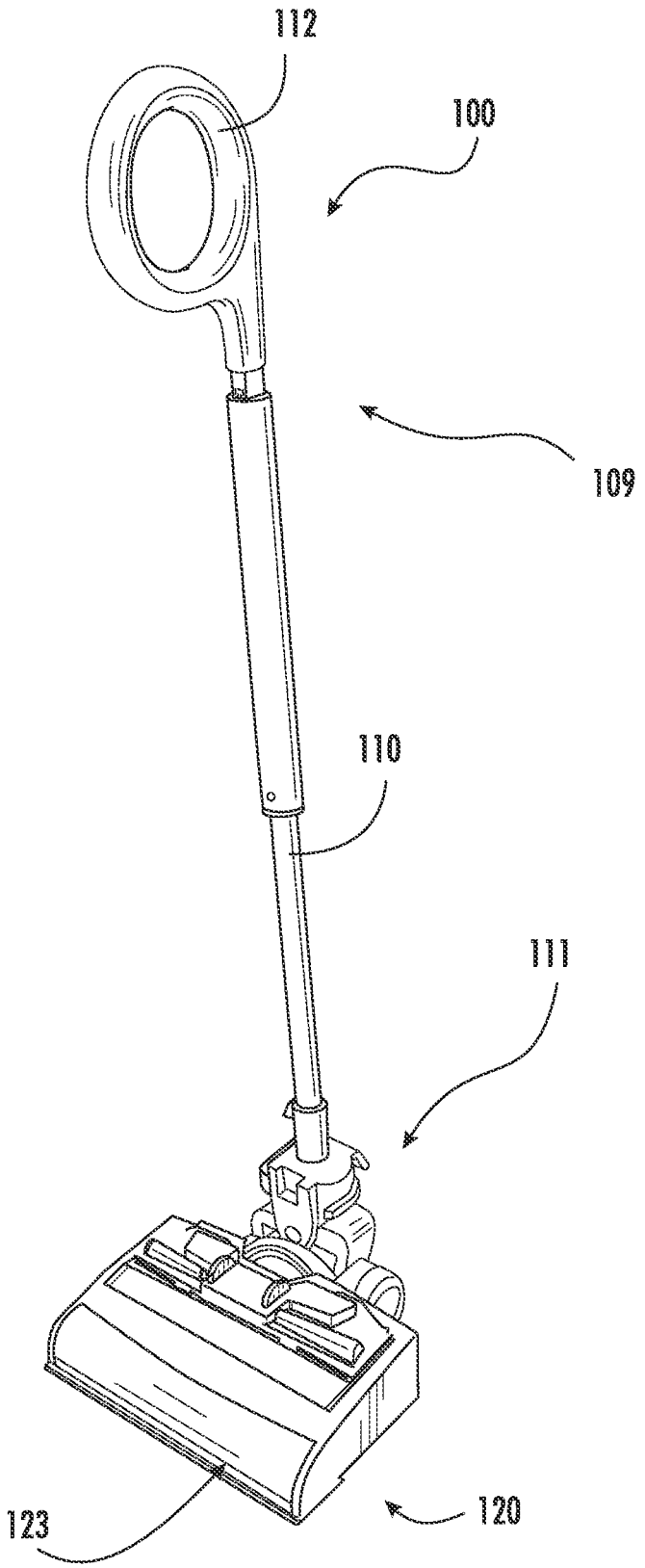
FIG. 1B is another perspective view of the multi-mode cleaning apparatus of FIG. 1A.
Figure 1C:
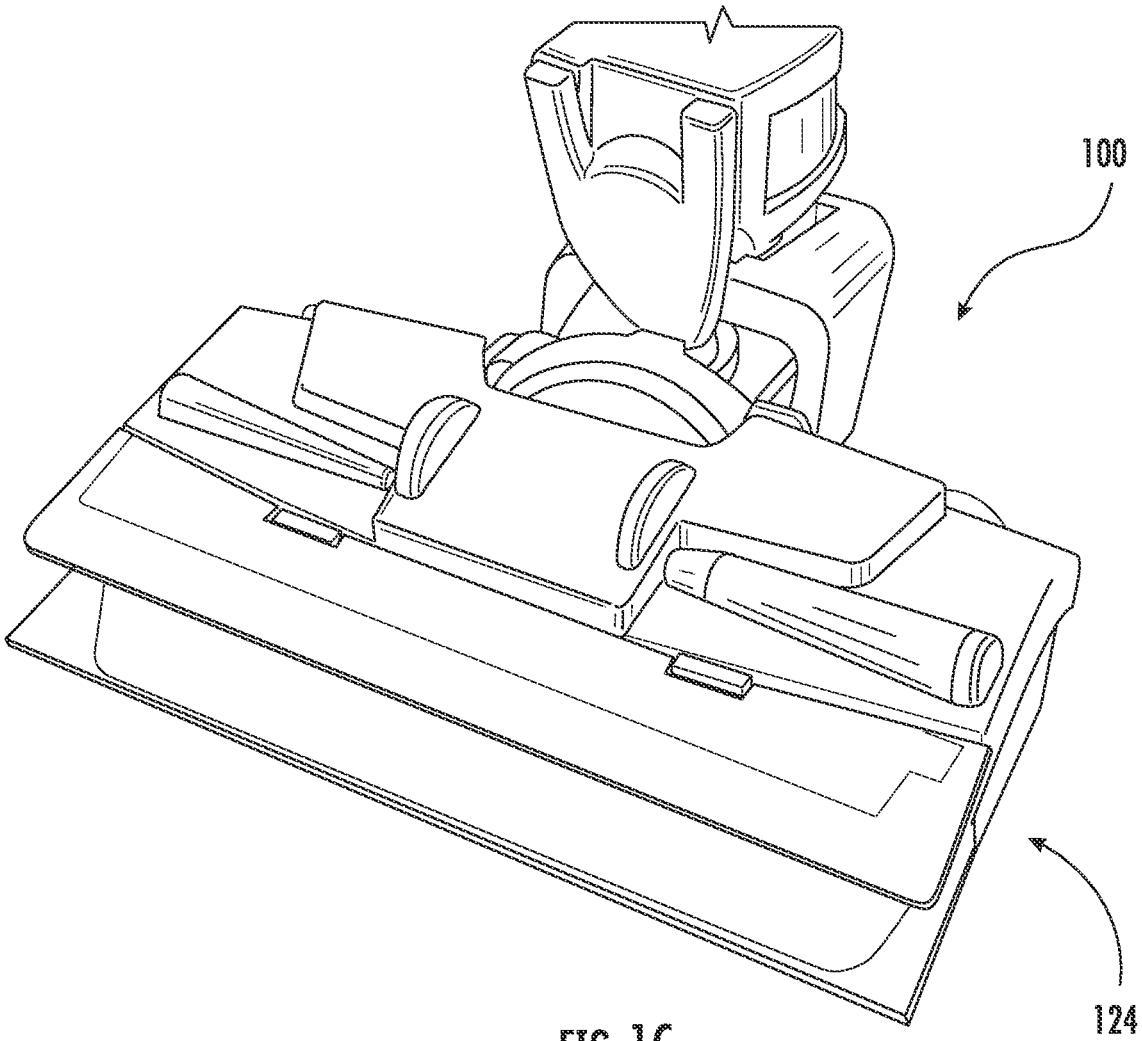
FIG. 1C is a perspective view generally illustrating one embodiment of the multi-mode cleaning apparatus of FIG. 1A with just suction, consistent with an embodiment of the present disclosure.

Referring to FIGS. 1A-1C, an embodiment of a multi-mode cleaning apparatus 100 includes a wand 110 with a handle 112 at one end 109 and one or more cleaning heads or units 120 at the other end 111. A suction motor (not shown) may be located in either the wand 110 or in one of the cleaning heads or units 120. The suction motor may include any type of motor and device (e.g., an impeller) for creating suction. The multi-mode cleaning apparatus 100 may be corded or cordless (e.g., with a rechargeable battery). In this embodiment, FIGS. 1A and 1B show a sweeper unit 122 including a brush roll 123 for use with a sweeper mode (e.g., the brush roll only mode or the brush roll and suction mode) and FIG. 1C shows only a bare floor unit 124 for use with the suction only mode.

Figure 2C:
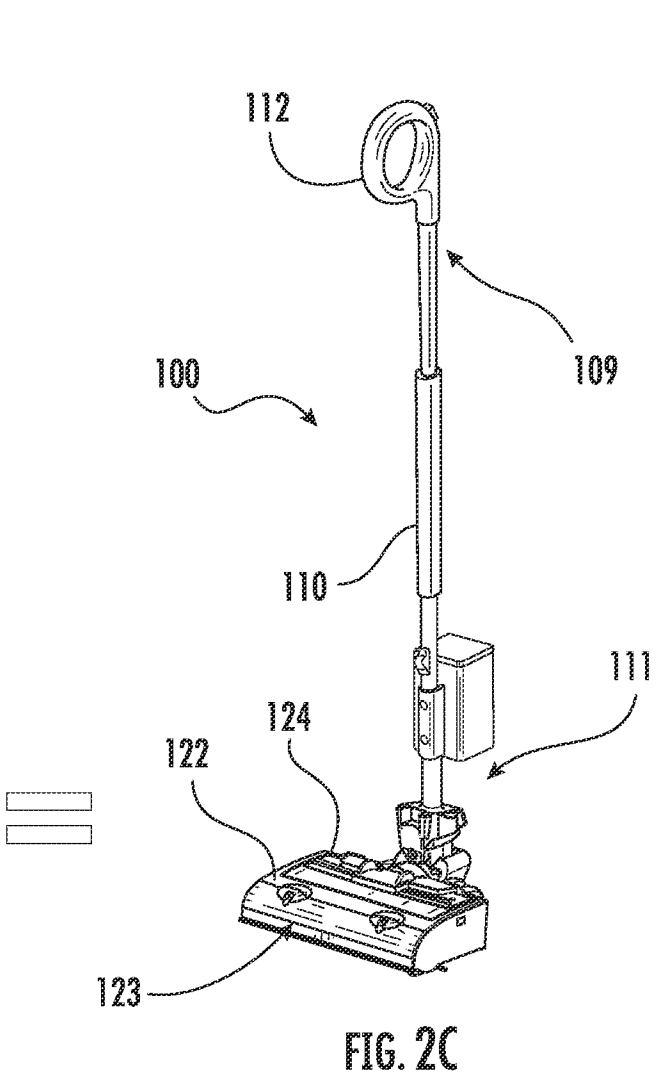
FIG. 2C is a perspective view generally illustrating one embodiment of a multi-mode cleaning apparatus including a bare floor unit of FIG. 2A and the sweeper unit of FIG. 2B, consistent with an embodiment of the present disclosure.
Figure 2B:
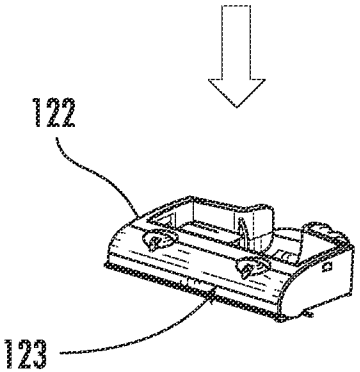
FIG. 2B is a perspective view generally illustrating one embodiment of a sweeper unit, consistent with an embodiment of the present disclosure.
Figure 2A:
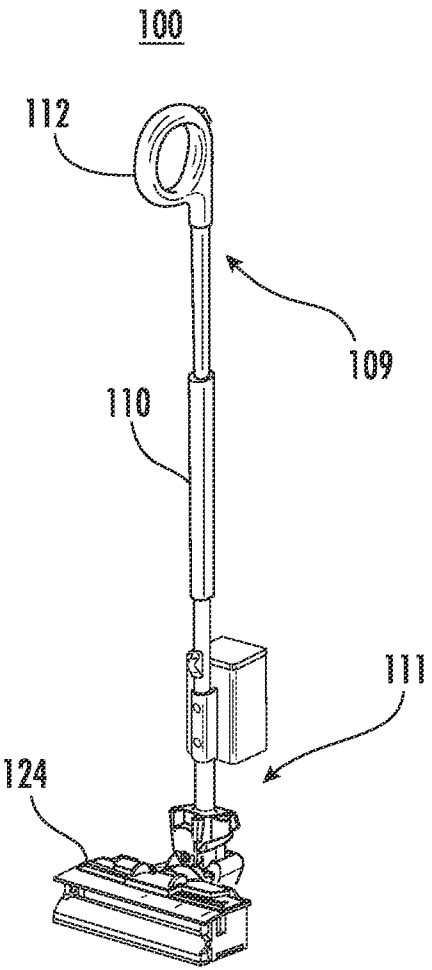
FIG. 2A is a perspective view generally illustrating another embodiment of a multi-mode cleaning apparatus including a bare floor unit, consistent with an embodiment of the present disclosure.

In this embodiment of the multi-mode cleaning apparatus 100, as shown in FIGS. 2A-2C, the bare floor unit 124 is coupled to the second end 111 of the wand 110 and the sweeper unit 122 is a separate attachment including a brush roll 123. The bare floor unit 124 may be used alone (FIG. 2A) for a suction only mode and the bare floor unit 124 may be attached to the sweeper unit 122 for use in one of the sweeper modes (FIG. 2C).

Figure 3A:
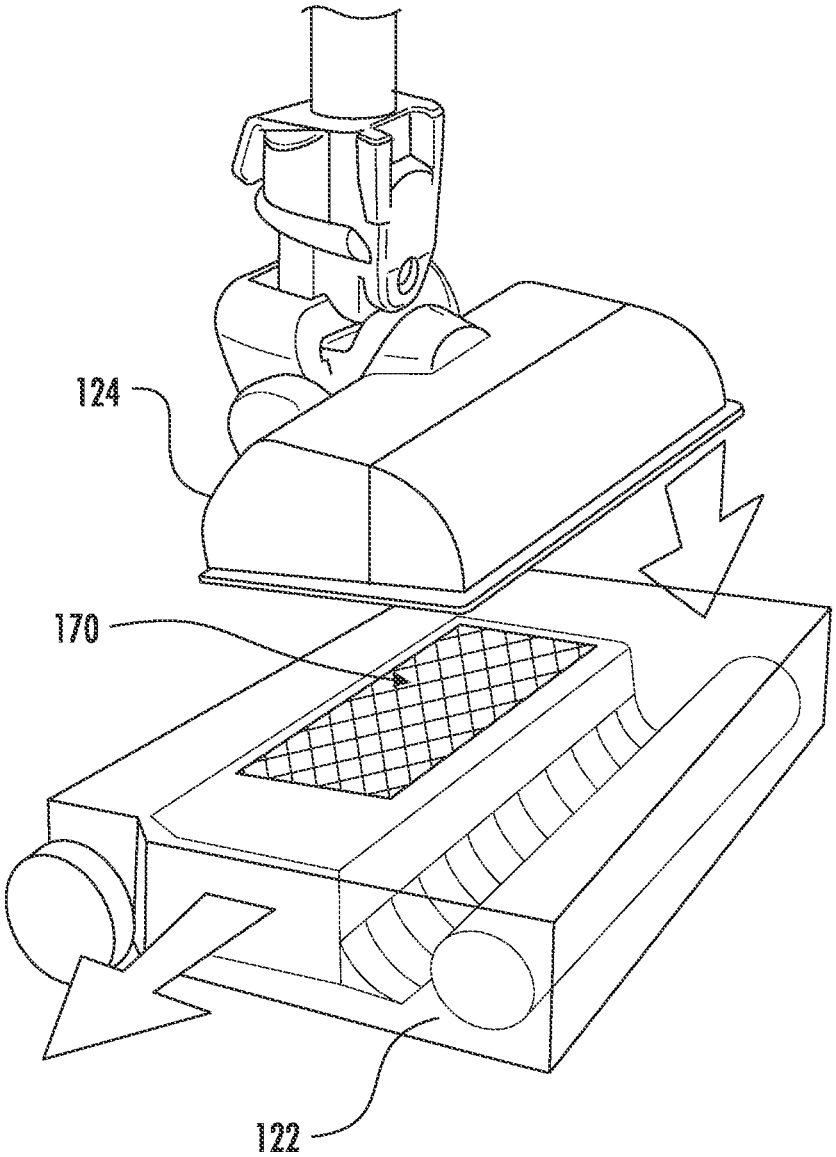
FIG. 3A is an exploded view generally illustrating the coupling of a bare floor unit with a sweeper unit in an embodiment of the multi-mode cleaning apparatus, consistent with an embodiment of the present disclosure.
Figure 3B:
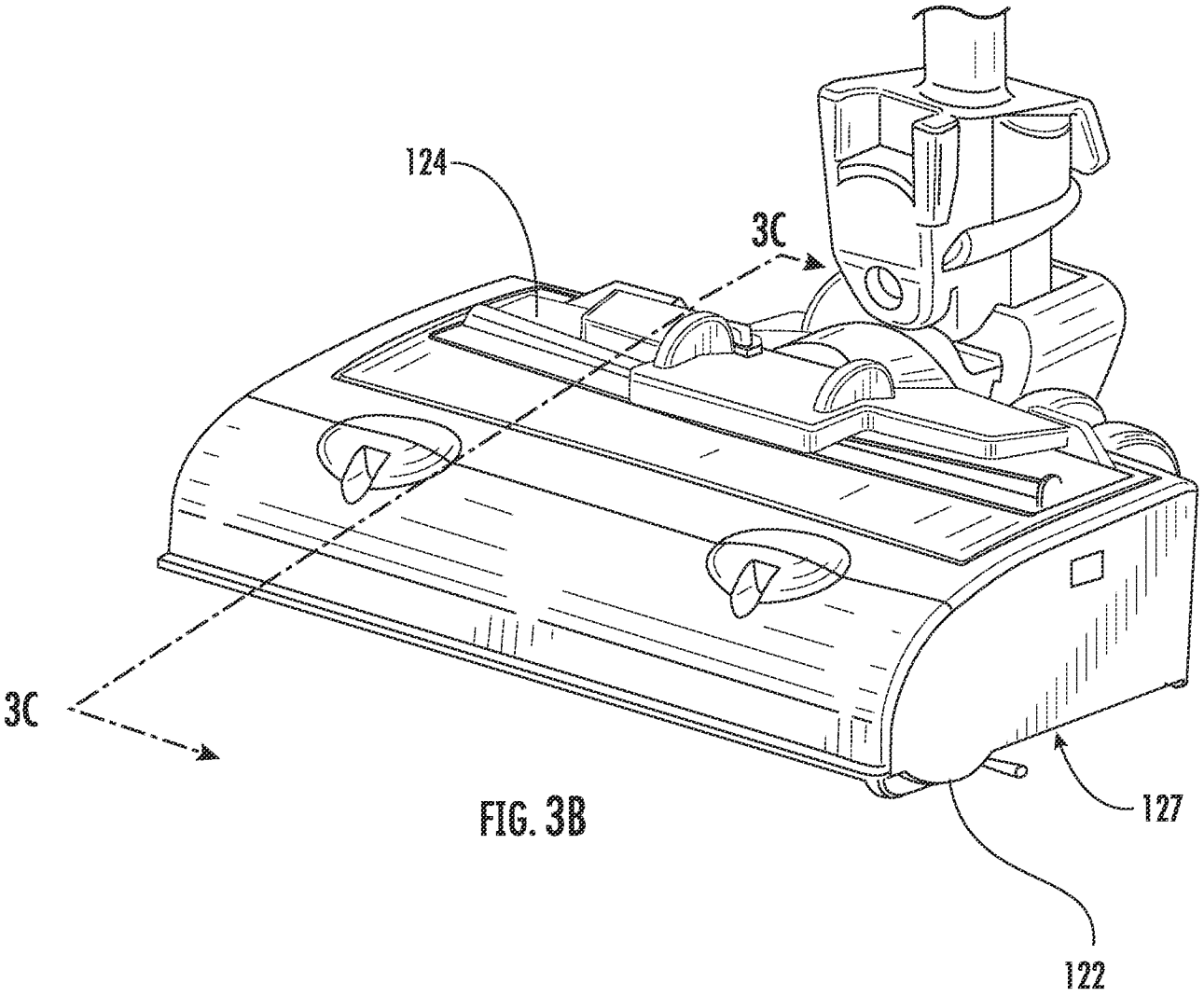
FIG. 3B is an assembled view generally illustrating the coupling of a bare floor unit with a sweeper unit of FIG. 3A.
Figure 3C:
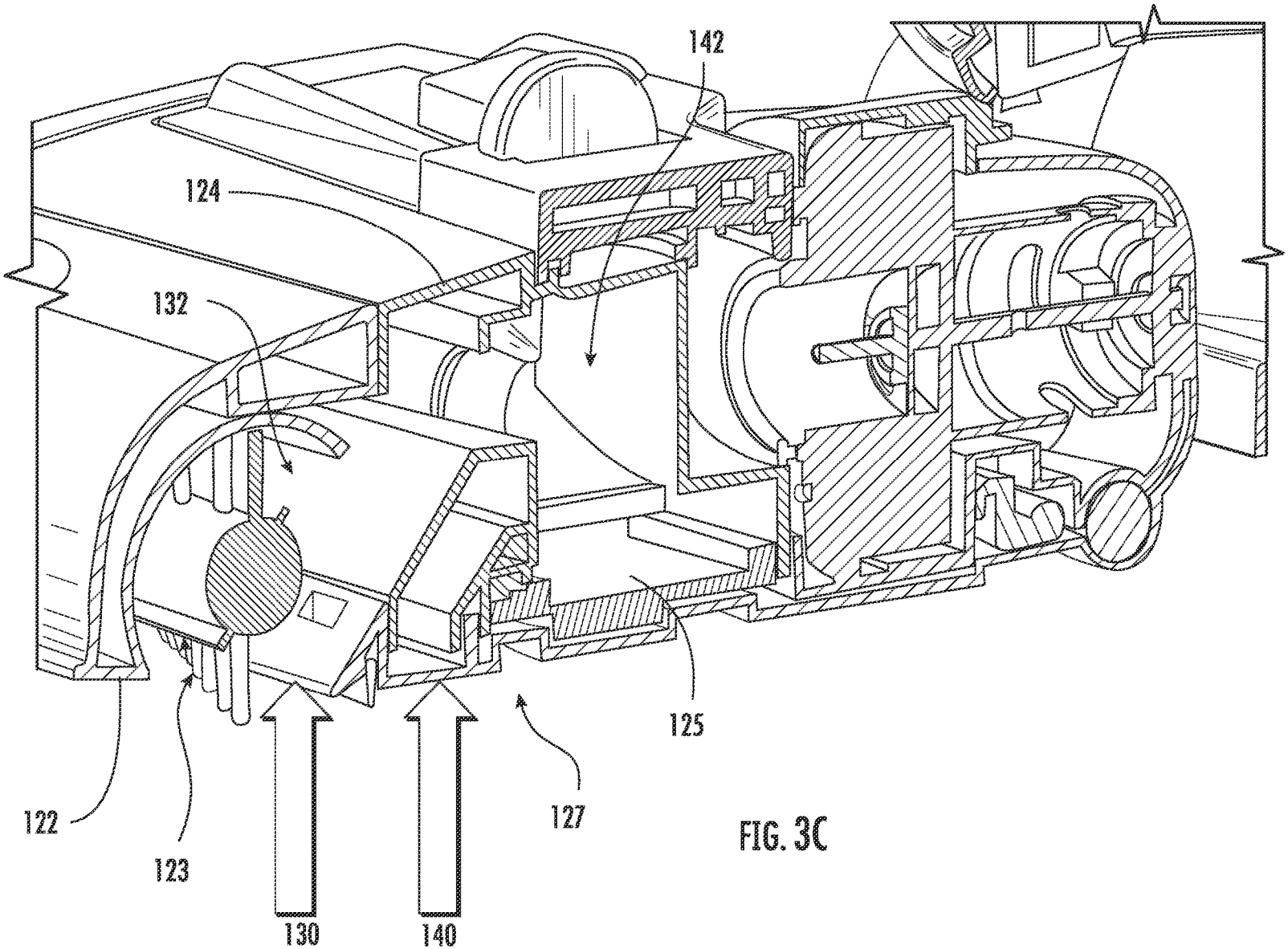
FIG. 3C is a cross-sectional view of FIG. 3B taken along lines 3C-3C.

As shown further in FIGS. 3A-3C, the bare floor unit 124 may be secured, mounted, or otherwise coupled to the sweeper unit 122. In at least one embodiment, the bare floor unit 124 may be nested within or mounted on top of the sweeper unit 122 to attach the sweeper unit 122. For example, the sweeper unit 122 may be fluidly coupled to the bare floor unit 124 such that debris dislodged by the brush roll 123 of the sweeper unit 122 is entrapped in the suction flow is transported to a dust cup/debris chamber 125 and optionally through one or more filters 170. Alternatively (or in addition), the sweeper unit 122 may be coupled to the bare floor unit 124 such that the bare floor unit 124 provides electricity to one or more motors of the sweeper unit 122. Other attachments are also contemplated and within the scope of the present disclosure.

With reference to FIG. 3C, the sweeper unit 122 and the bare floor unit 124 each include inlets 130, 140 on a bottom side 127 for receiving the debris when each of the respective units 122, 124 are being used. The sweeper unit 122 and the bare floor unit 124 also each include an air path 132, 142 extending from the respective inlets 130, 140. When the bare floor unit 124 is used alone (e.g., as generally illustrated in FIG. 2A), the bare floor inlet 140 receives the debris and the debris passes through the bare floor air path 142 (e.g., via suction). When the sweeper unit 122 is used, the bare floor inlet 142 is closed or covered and the sweeper air path 132 is fluidly connected to the bare floor air path 142 such that the sweeper inlet 130 receives the debris and the debris passes through the sweeper air path 132 into the bare floor air path 142.

In this embodiment, the bare floor unit 124 includes a dust cup 125 along the bare floor air path 142 (i.e., fluidly coupled to and/or disposed within the floor air path 142) for receiving debris that passes into the bare floor air path 142. The sweeper unit 122 includes a brush roll 123 proximate the sweeper inlet 130. Thus, the debris may be collected in the dust cup 125 by way of suction and/or by way of the rotating brush roll 123. The bare floor unit 124 may also include the suction motor and the sweeper unit 122 may include a brush roll drive motor and drive mechanism. The sweeper unit 122 may be configured to be electrically coupled to the bare floor unit 124 such that the brush roll drive motor receives power from the bare floor unit 124. As such, the sweeper unit 122 and the bare floor unit 124 may include one or more electrically connections. Alternatively, the sweeper unit 122 may include an electrical connection that is configured to be coupled directed to a power source (e.g., one or more batteries and/or electrical outlet).

Figure 4A:
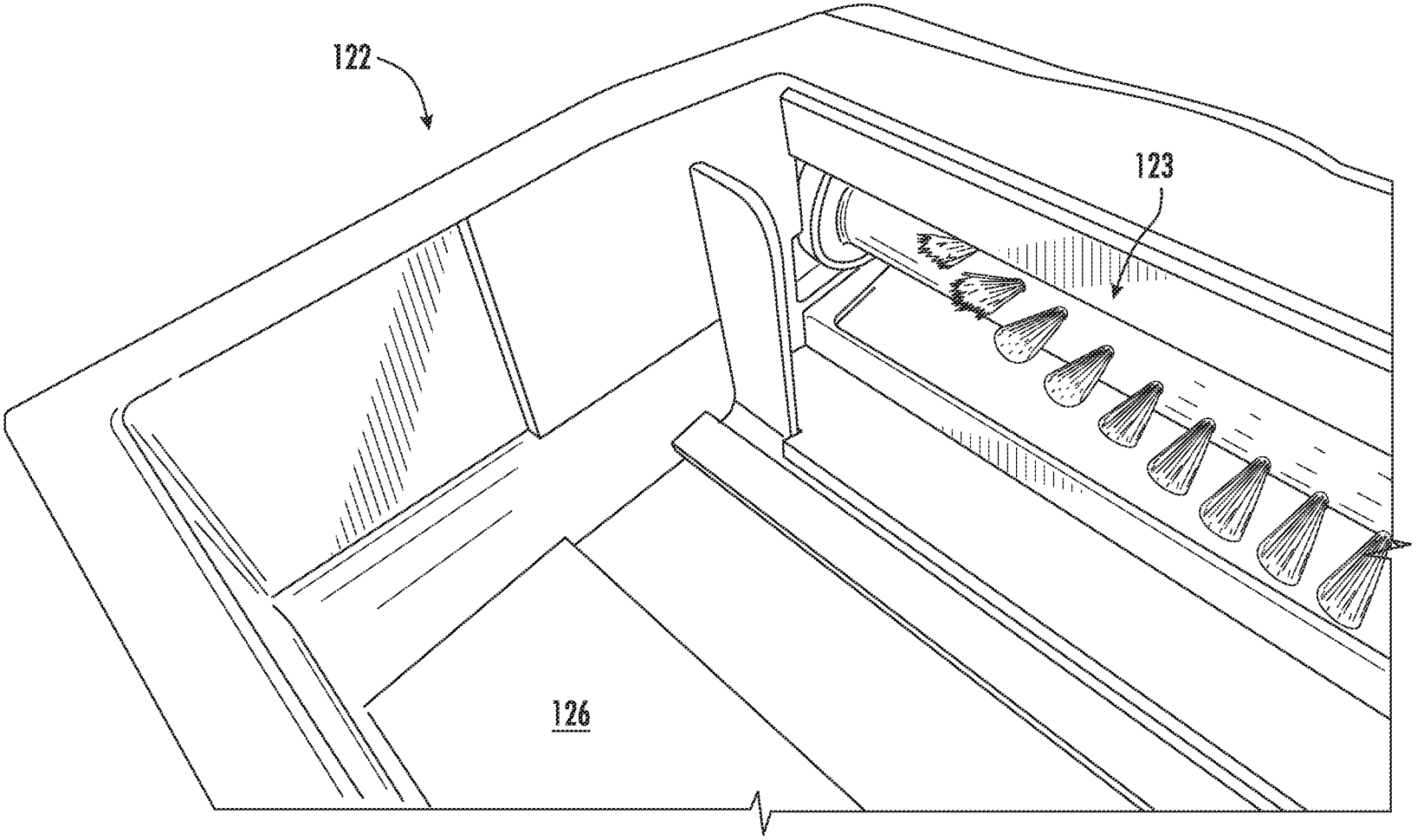
FIG. 4A is a rear perspective view generally illustrating one embodiment of a sweeper unit of the multi-mode cleaning apparatus, consistent with an embodiment of the present disclosure.
Figure 4B:
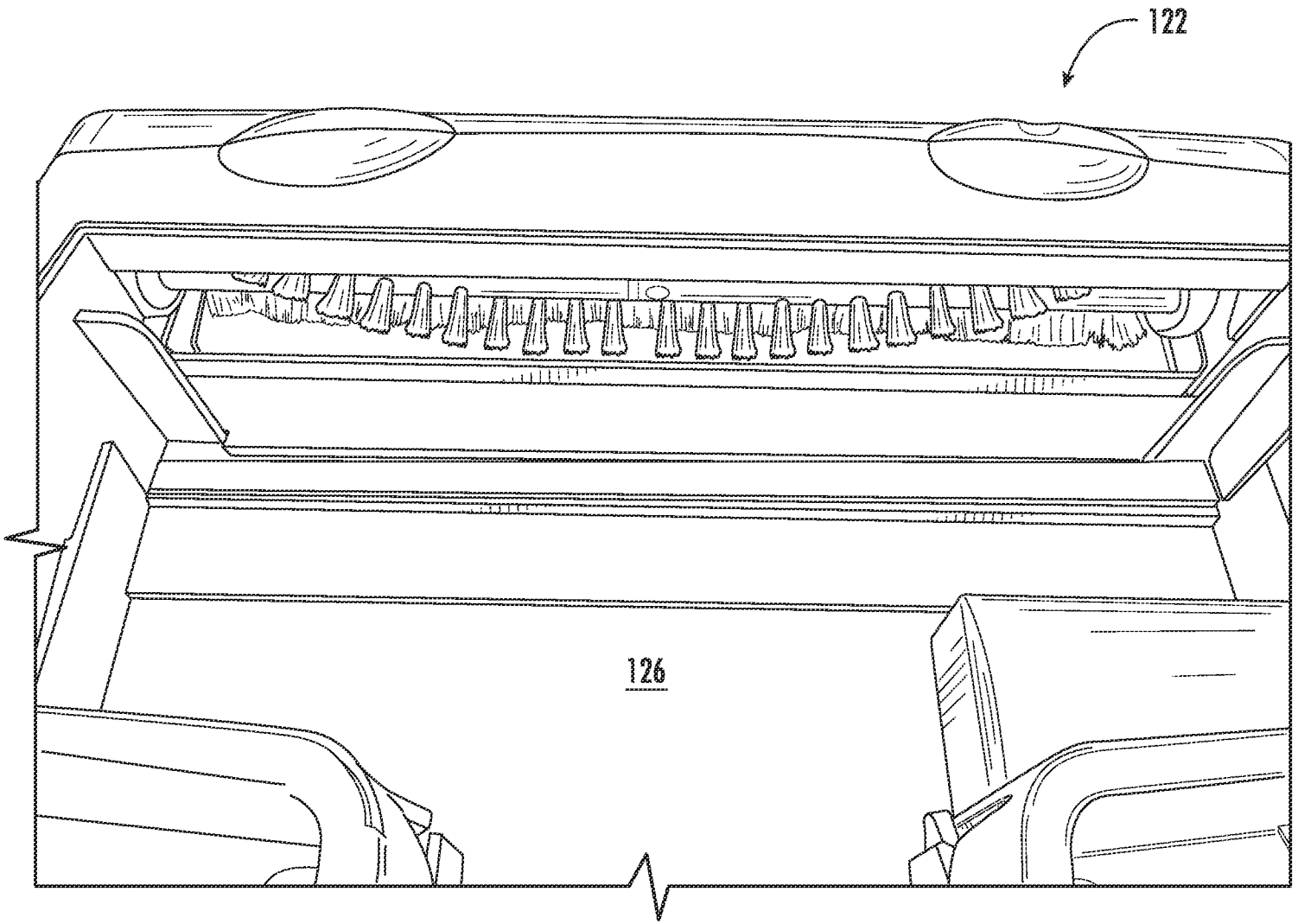
FIG. 4B is a top view of the sweeper unit of FIG. 4A.
Figure 4C:
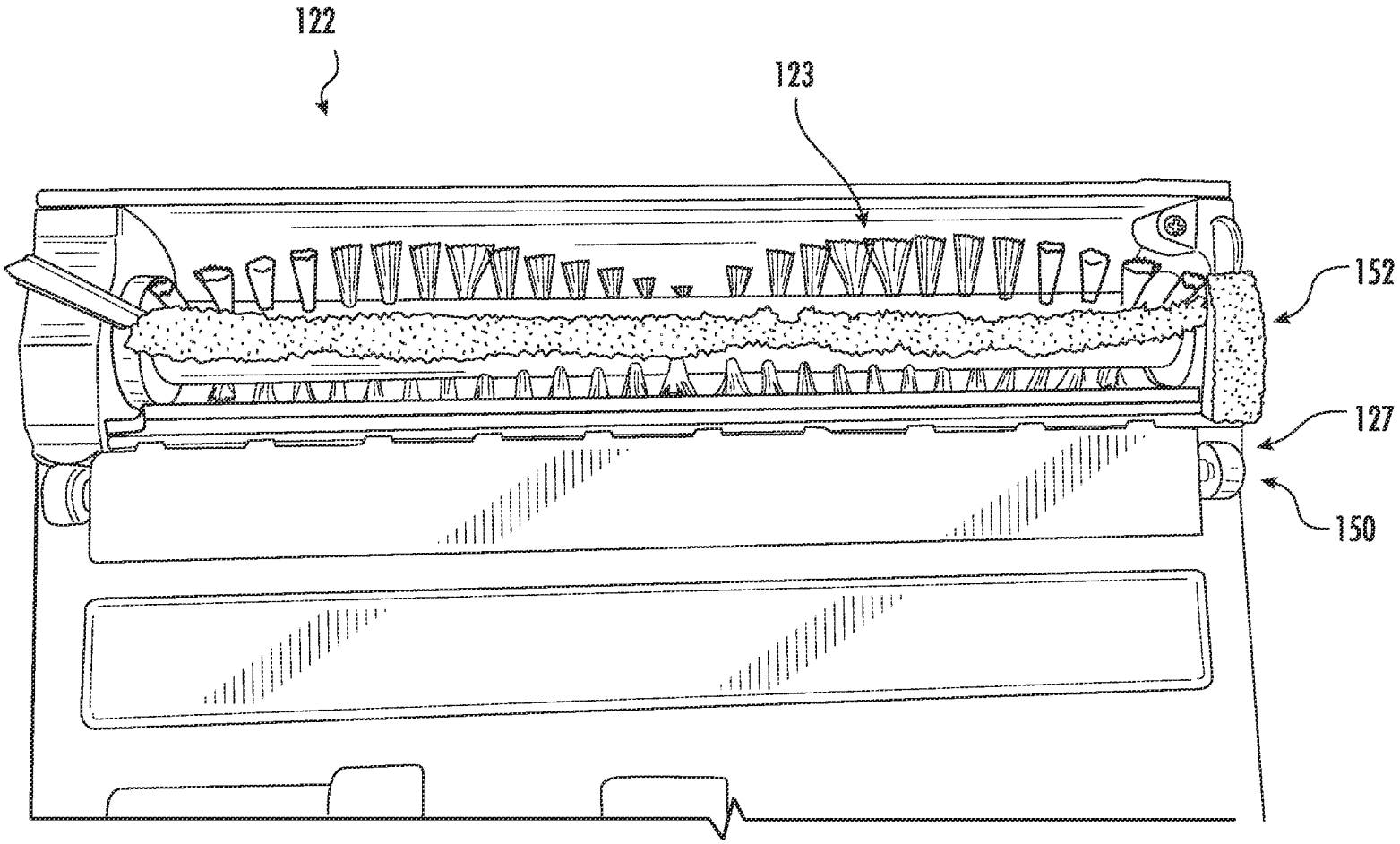
FIG. 4C is a bottom view of the sweeper unit of FIG. 4A.
Figure 4D:
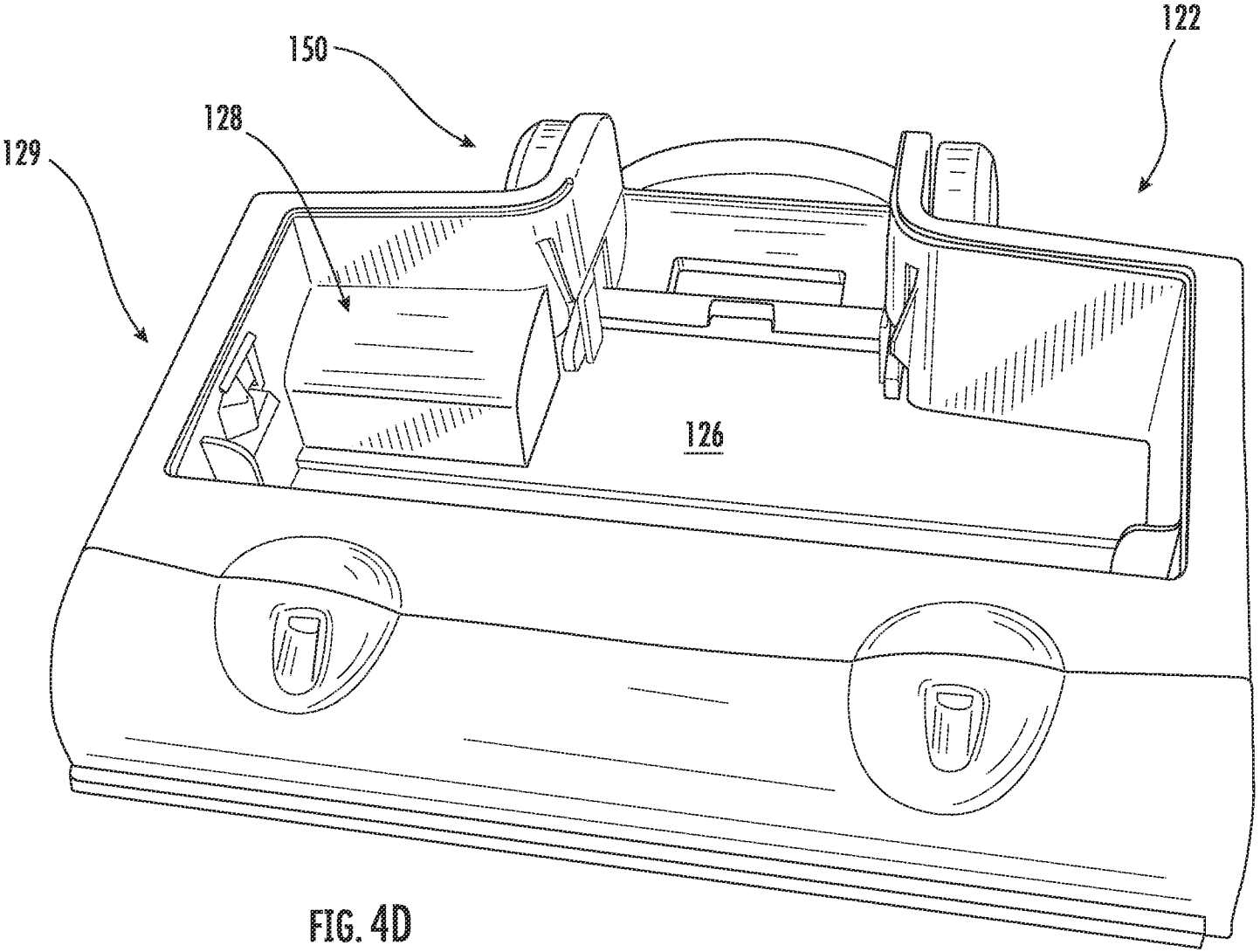
FIG. 4D is a front view of the sweeper unit of FIG. 4A.

FIGS. 4A-4D show an embodiment of the sweeper unit 122 in greater detail. In this embodiment, the brush roll 123 is located at a front portion of the sweeper unit 122 and the sweeper unit 122 defines a chamber 126 for receiving the bare floor unit 124. With reference to FIG. 4D, a drive motor 128 and drive mechanism 129 may be located at one side of the sweeper unit 122 for driving the brush roll 123. The drive mechanism 129 may include one or more gears and/or belts. The sweeper unit 122 may also include one or more wheels 150 (e.g., but not limited to, located proximate a rear portion and/or middle portion of the sweeper unit 122) and a felt pads 152 or other soft fabric or textiles for contacting the surface being cleaned. The felt pads 152 may be located along various portions of the bottom side 127 of the sweeper unit 122 (e.g., as illustrated in FIG. 4C) and may be configured to generally seal the bottom side 127 to the surface being cleaned and/or to reduce damage (e.g., scratching) of the surface being cleaned. The brush roll 123 may include any type of brush roll used in a surface cleaning apparatus including, without limitation, brush rolls with bristles.

Figure 5:
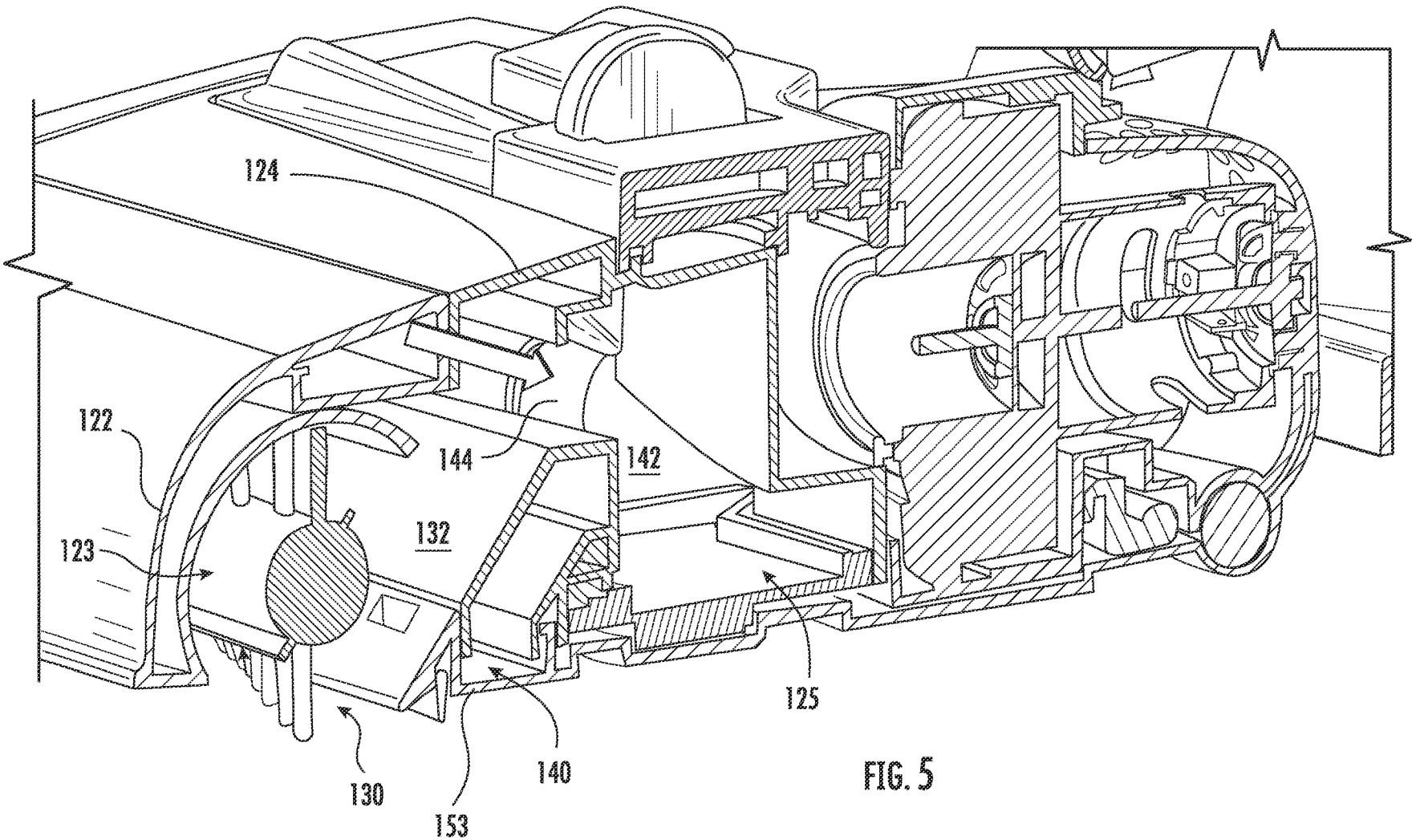
FIG. 5 is a cross-sectional view generally illustrating air paths through the bare floor unit coupled with the sweeper unit in the multi-mode cleaning apparatus, consistent with an embodiment of the present disclosure.
Figure 6A:
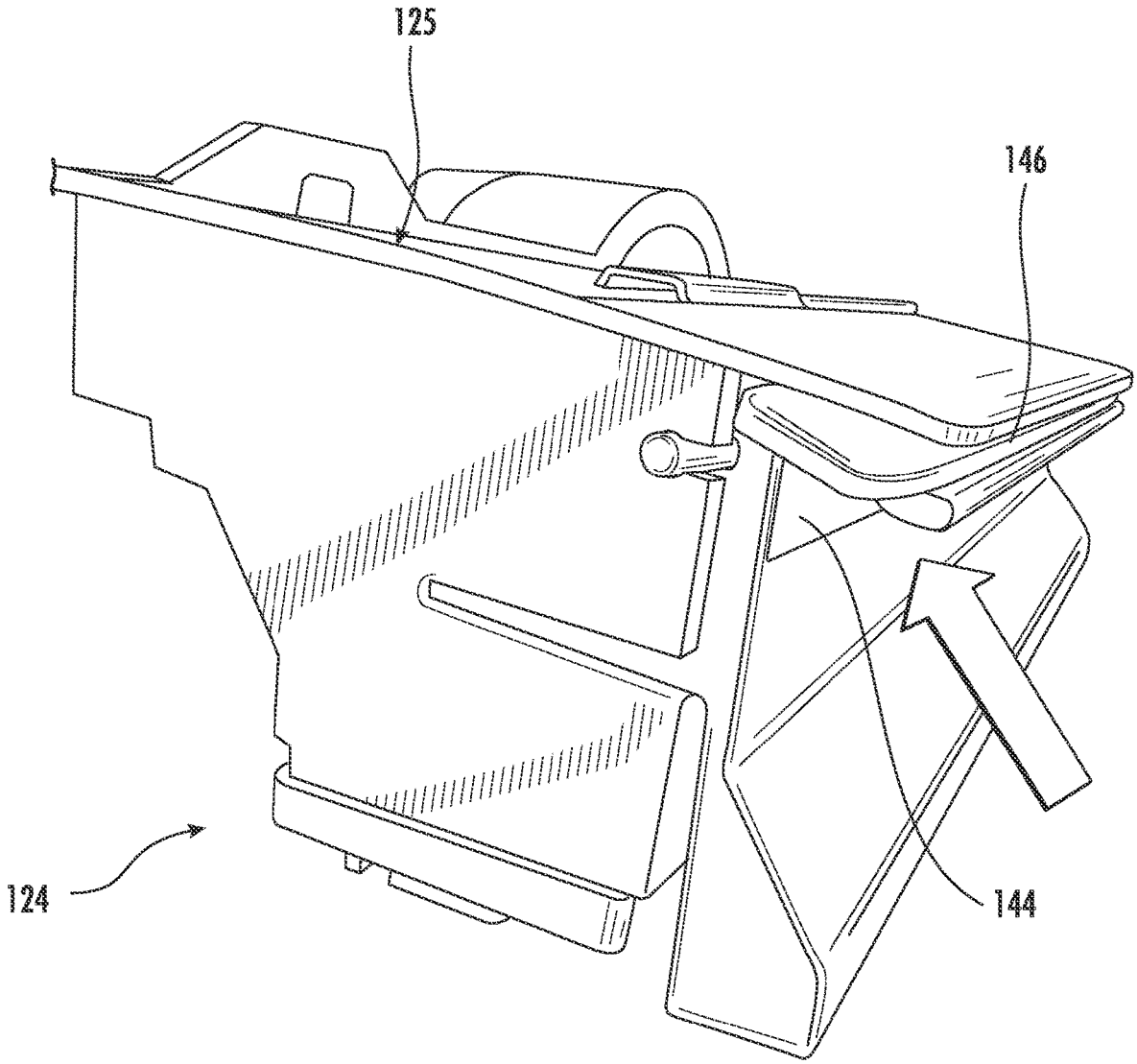
FIG. 6A is a side perspective view generally illustrating one embodiment of a diverter door in an open opening position with respect to an alternate suction inlet in an embodiment of the bare floor unit of the multi-mode cleaning apparatus, consistent with an embodiment of the present disclosure.
Figure 6B:
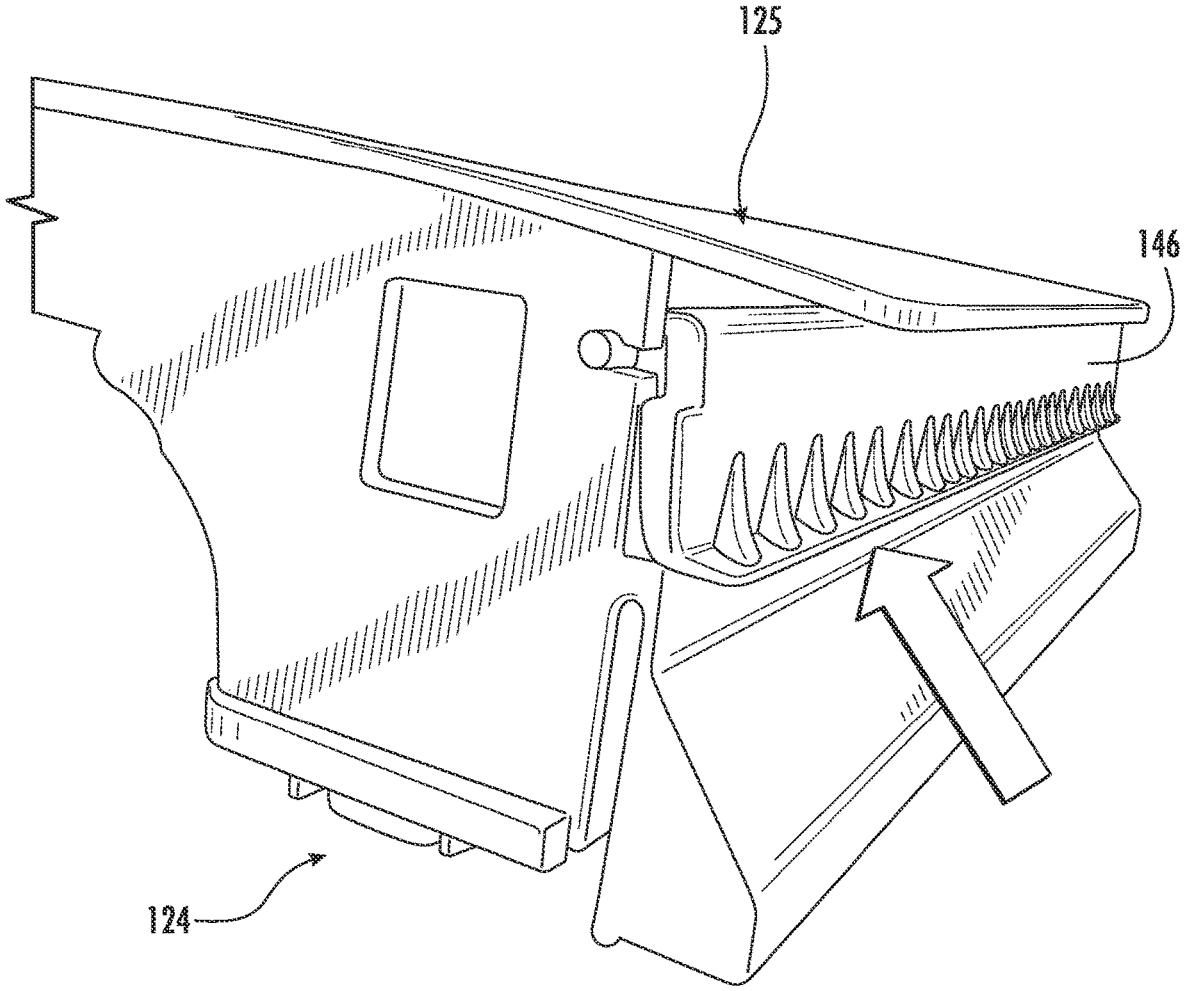
FIG. 6B is a side perspective views of the diverter door of FIG. 6A in a closed position with respect to the alternate suction inlet.

To allow the sweeper inlet 130 to be used instead of the bare floor inlet 140, as shown in FIG. 5, the example embodiment of the bare floor unit 124 includes an alternate suction inlet 144 that is opened when the bare floor unit 124 is coupled to the sweeper unit 122. The bare floor inlet 142 is sealed to a sole plate 153 of the sweeper unit 122 such that air passes from the sweeper inlet 130 through the sweeper air path 132 through the alternate suction inlet 144 and into the bare floor air path 142. As may be appreciated, the sole plate 153 of the sweeper unit 122 defines at least a portion of the bottom side 127 of the sweeper unit 122. According to one embodiment, shown in FIGS. 6A and 6B, the alternate suction inlet 144 of the bare floor unit 124 is covered by a pivotable diverter door 146 on an upper portion above the dust cup 125. The diverter door 146 may be biased in a closed position (e.g., using a spring) such that the alternate suction inlet 144 is closed when the bare floor unit 124 is used alone. The diverter door 146 may engage a ledge or other structure in the chamber 126 of the sweeper unit 122 such that the diverter door 146 opens when the bare floor unit 124 is received in the chamber 126 of the sweeper unit 122.

Figure 7A:
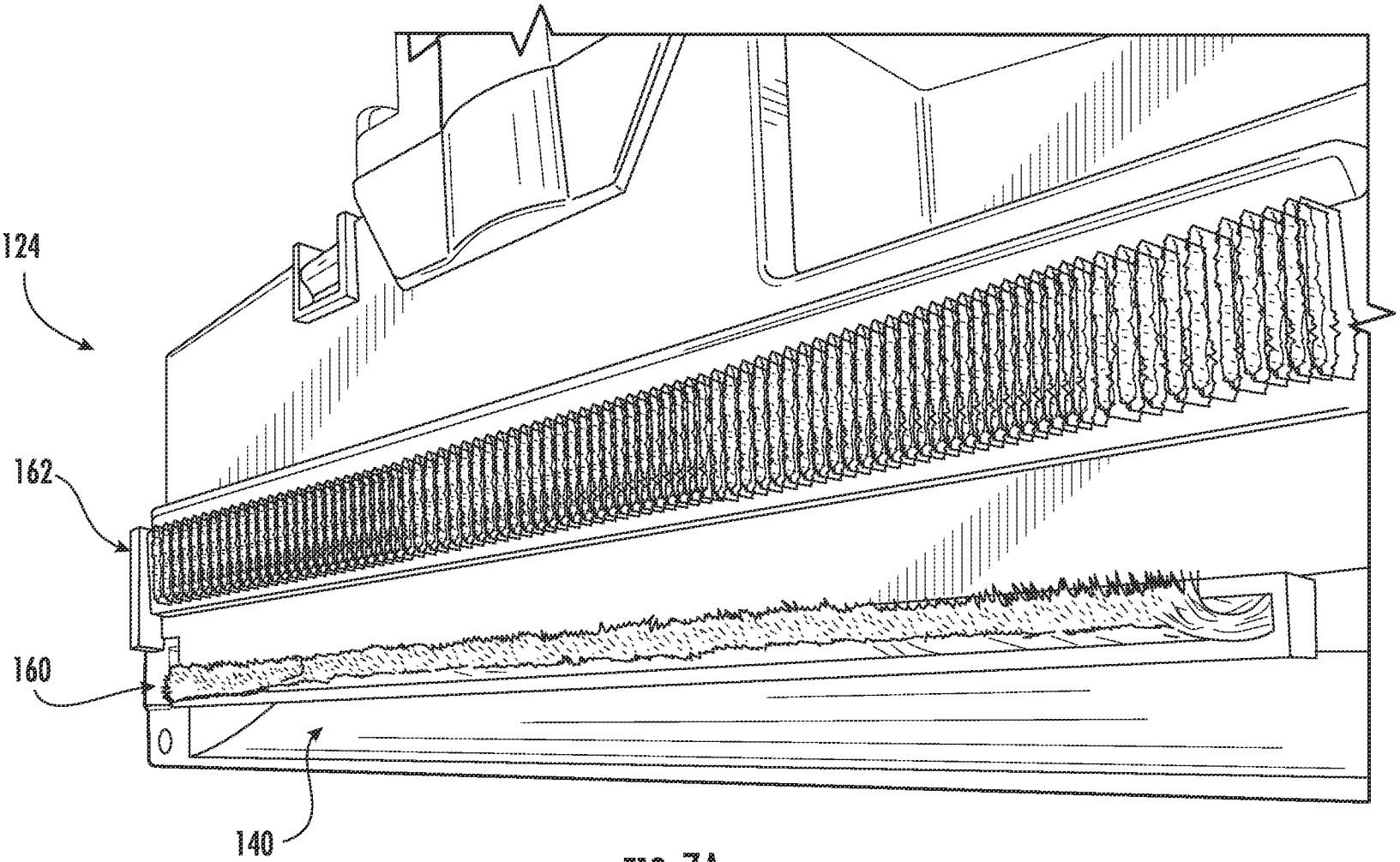
FIG. 7A generally illustrates a front bottom side of an embodiment of the bare floor unit of the multi-mode cleaning apparatus, consistent with an embodiment of the present disclosure.
Figure 7B:
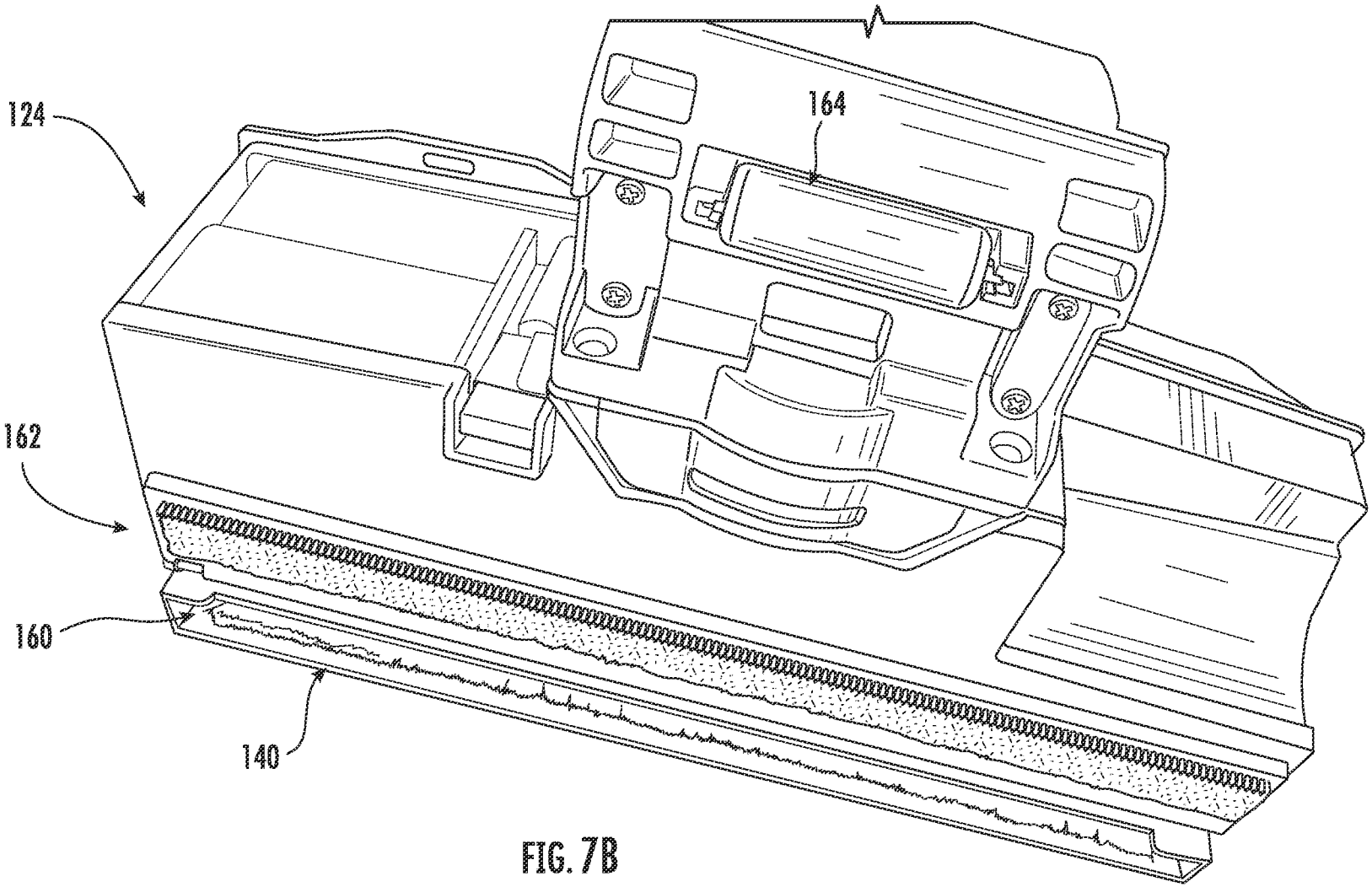
FIG. 7B generally illustrates a rear bottom side of the bare floor unit of FIG. 7A.

FIGS. 7A and 7B show a bottom side of an example embodiment of the bare floor unit 124 in greater detail. As shown, one or more cleaning elements 160 may be located on either side of the bare floor inlet 140 for contacting the surface being cleaning. The cleaning element(s) 160 may include one or more strips of bristles, felt, nap, pile, fabric, textile or any other soft material. The cleaning element(s) 160 may seal off at least a portion of the bare floor inlet 140 to improve suction. The bare floor unit 124 may also include support strip 162 (e.g., a felt strip) and one or more wheels 164 (FIG. 7B) for supporting the bare floor unit 124 on the surface being cleaned.

Figure 8A:
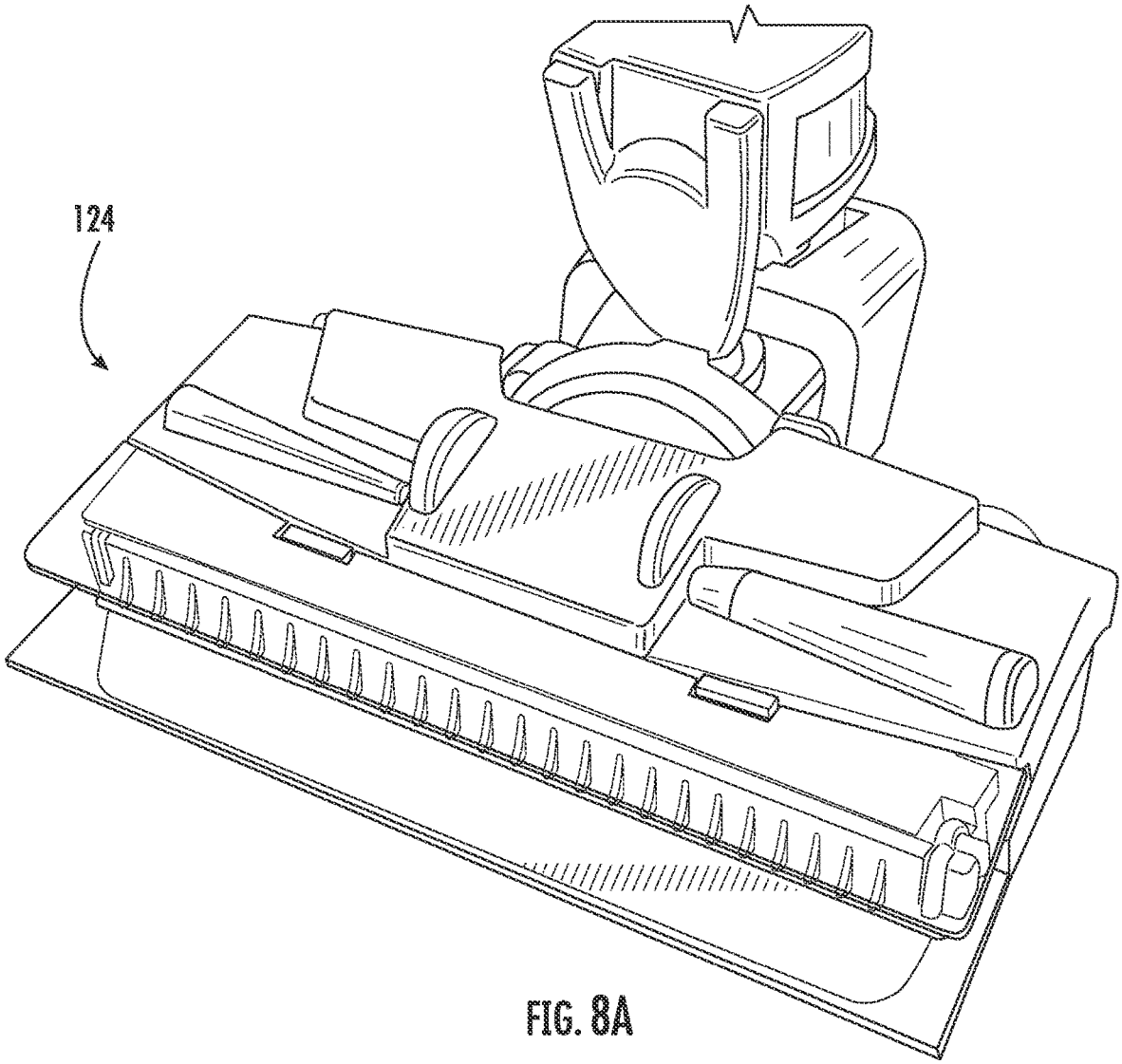
FIG. 8A generally illustrates one embodiment of a multi-mode cleaning apparatus capable of operating in different modes, wherein the multi-mode cleaning apparatus is used in a suction mode without a brush roll, consistent with an embodiment of the present disclosure.
Figure 8B:
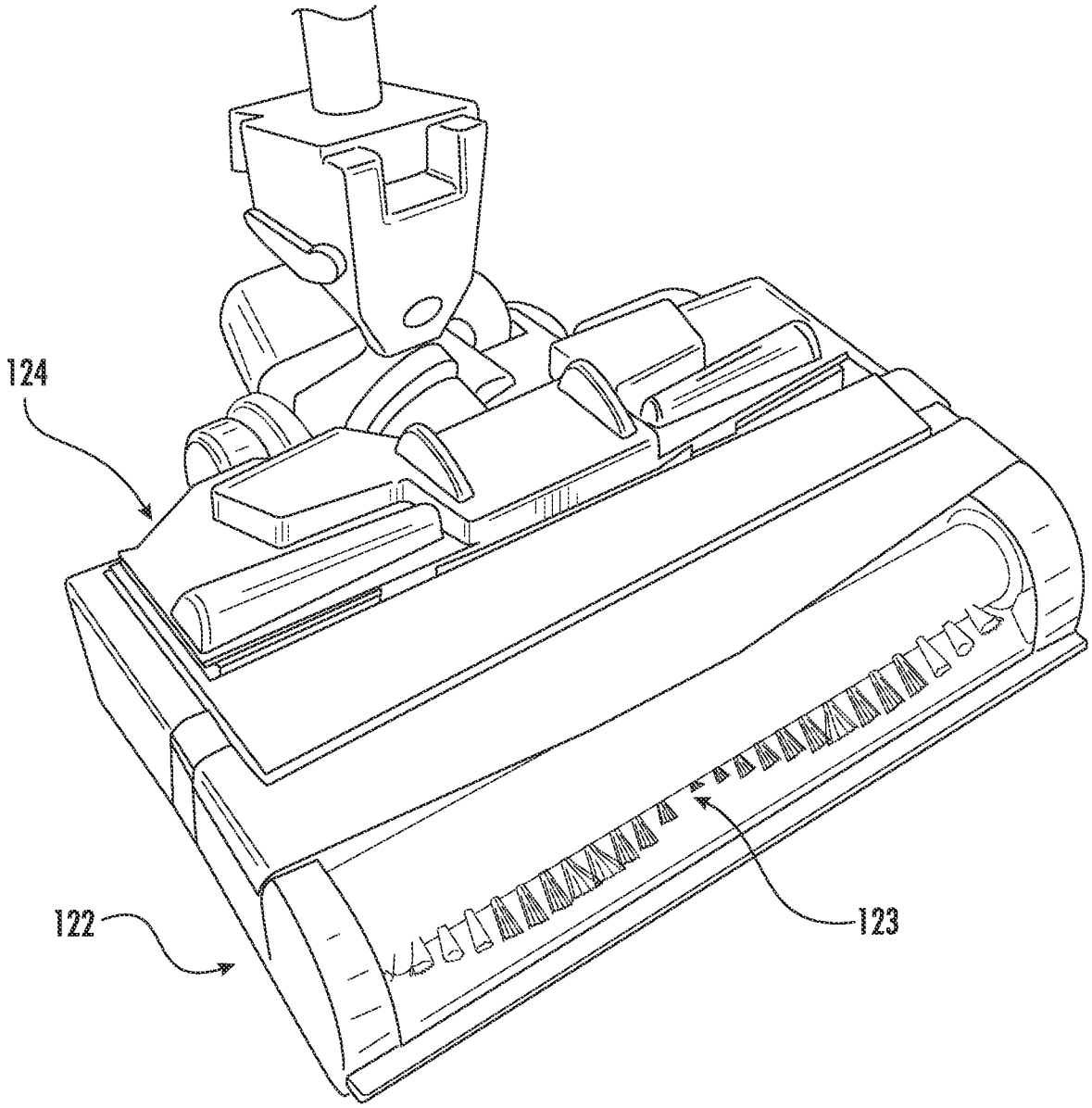
FIG. 8B generally illustrates one embodiment of the multi-mode cleaning apparatus of FIG. 8A that may be used in either a rotating brush mode with or without a suction mode, consistent with an embodiment of the present disclosure.

As shown in FIGS. 8A and 8B, this embodiment of the multi-mode cleaning apparatus 100 is capable of at least three modes of operation. In a first mode (FIG. 8A), the multi-mode cleaning apparatus 100 may include the bare floor unit 124 without the sweeper unit 122. In such an embodiment, the bare floor unit 124 may be used in a straight suction mode without a brush roll. In other embodiments, however, the bare floor unit 124 may include a brush roll as described in greater detail below. In such an embodiment, the brush roll of the bare floor unit 124 may be designed to work on a bare floor, whereas the brush roll 123 of the sweeper unit 122 may be designed to work on a carpeted floor. For example, the brush roll of the bare floor unit 124 may include soft bristles (e.g., but not limited to, felt bristles and/or rubber bristles or strips) designed to engage a bare floor without damaging the floor. In contrast, the brush roll 123 of the sweeper unit 122 may include bristles that are more rigid than the brush roll of the bare floor unit. For example, the bristles of the brush roll 123 of the may be designed to penetrate into the fibers of a carpet to dislodge debris within the carpet.

In a second and a third mode (FIG. 8B), the multi-mode cleaning apparatus 100 may include both the bare floor unit 124 and the sweeper unit 122. According to the second mode, the sweeper unit 122 may utilize the rotating brush roll 123 without any suction (e.g., without suction generated by the bare floor unit 124). In such an embodiment, the sweeper unit 122 may be coupled to the bare floor unit 124 such that a user can manipulate the sweeper unit 122 using the wand 110 and/or handle 112. The bare floor unit 124 may provide power to the sweeper unit 122; however, debris may be collected using just the rotating brush roll 123. According to the third mode, the sweeper unit 122 may utilize the rotating brush roll 123 in combination with suction (which may be generated by the bare floor unit 124). The multi-mode cleaning apparatus 100 may optionally include a switch configured to allow a user to selectively activate the suction feature when the sweeper unit 122 is coupled to the bare floor unit 124. A switch may also be provided to selectively power the brush roll 123.

Figure 9:
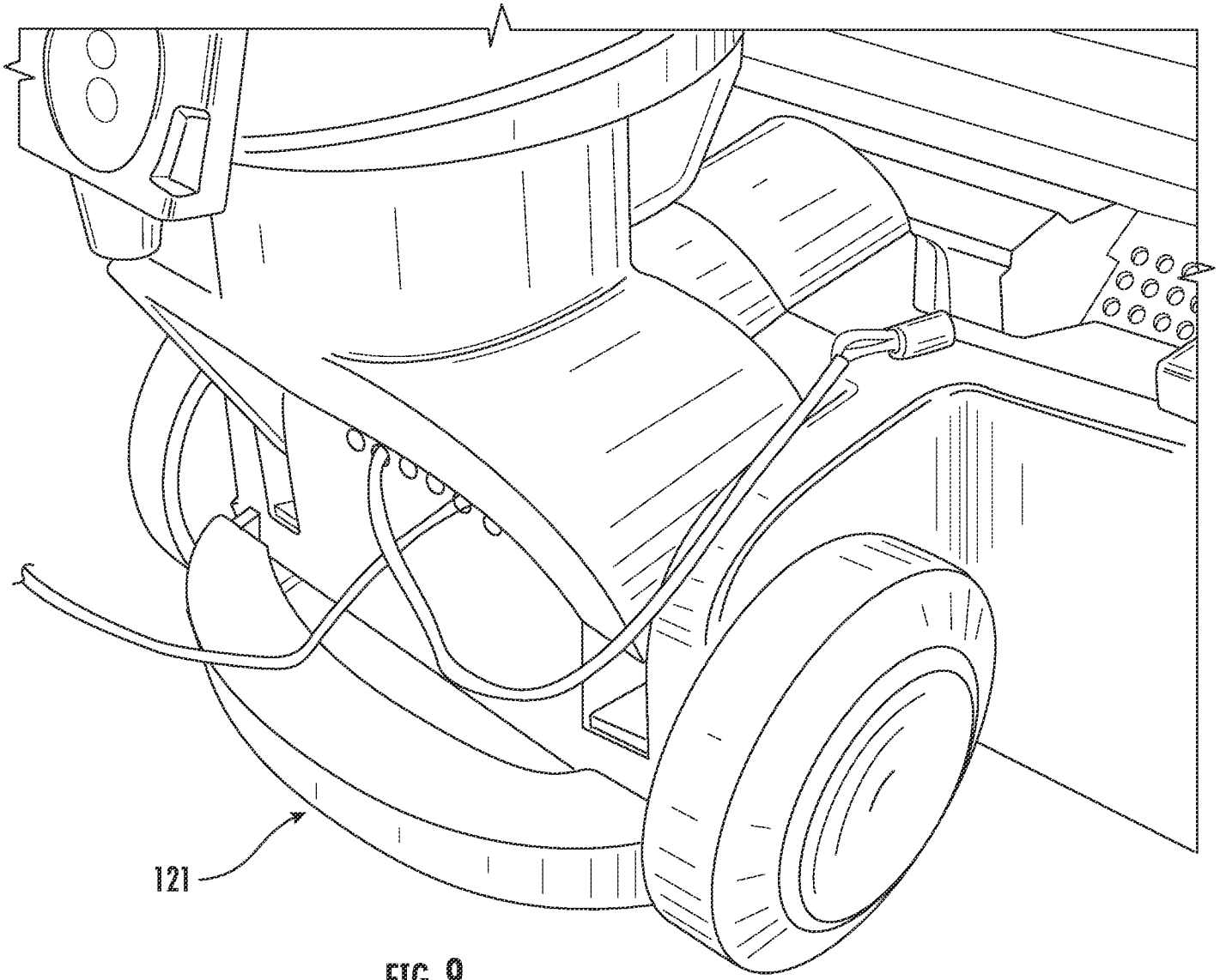
FIG. 9 generally illustrates a foot pedal for a release mechanism on an embodiment of the multi-mode cleaning apparatus, consistent with an embodiment of the present disclosure.

As shown in FIG. 9, the multi-mode cleaning apparatus 100 may also include a release mechanism that releasable secures the sweeper unit 122 to the bare floor unit 124. The release mechanism may include a button and/or foot pedal 121 that causes the sweeper unit 122 to be released, allowing the bare floor unit 122 to be raised and separated from the sweeper unit 122. For example, activating (e.g., depressing) the button and/or foot pedal 121 may cause one or more fastening devices (e.g., biased tabs, hooks, latches, or the like) to be released from a corresponding notch, groove, indentation, or the like, thereby allowing the sweeper unit 122 to be disconnected from the bare floor unit 124.

Figure 10A:
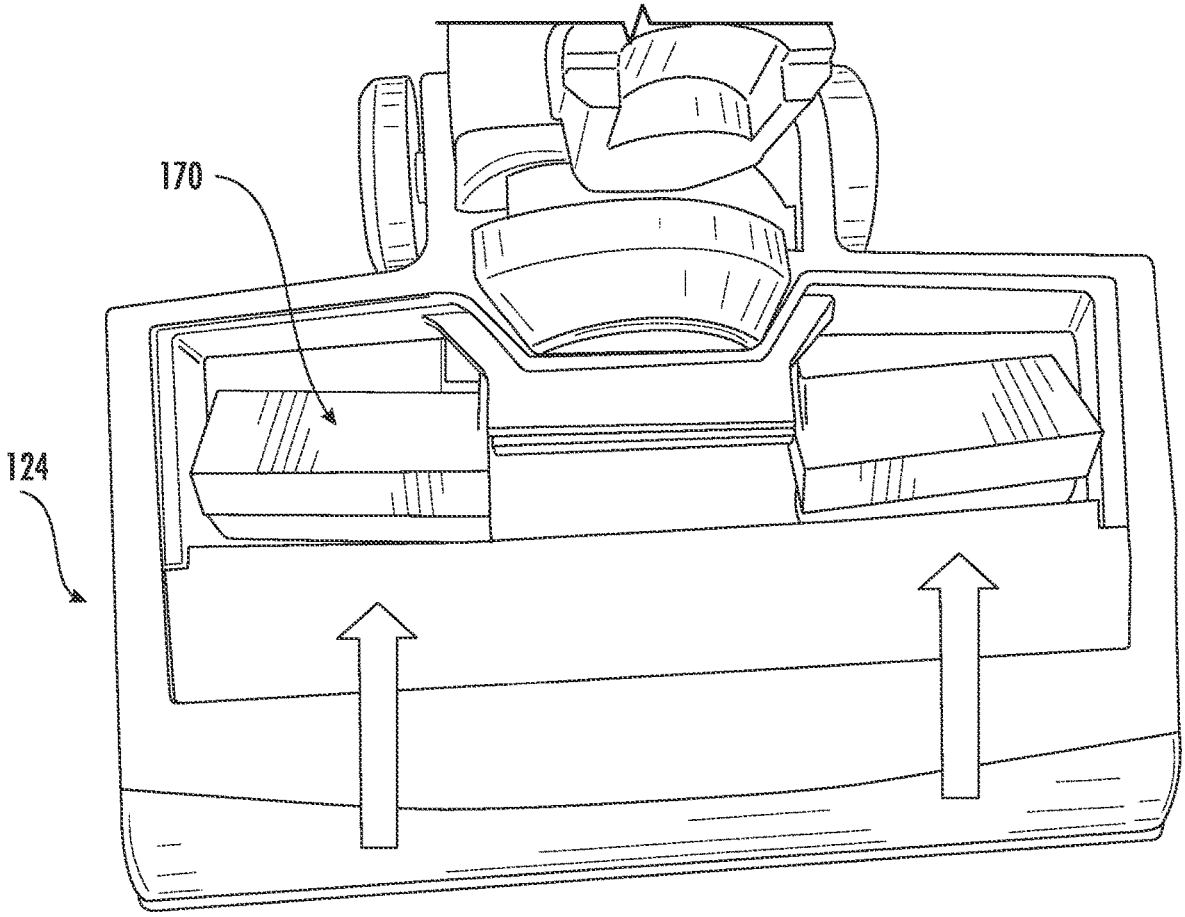
FIG. 10A generally illustrates one embodiment of a bare floor unit in an embodiment of a multi-mode cleaning apparatus including filters, a filter chamber cover and a filter chamber, consistent with an embodiment of the present disclosure.
Figure 10B:
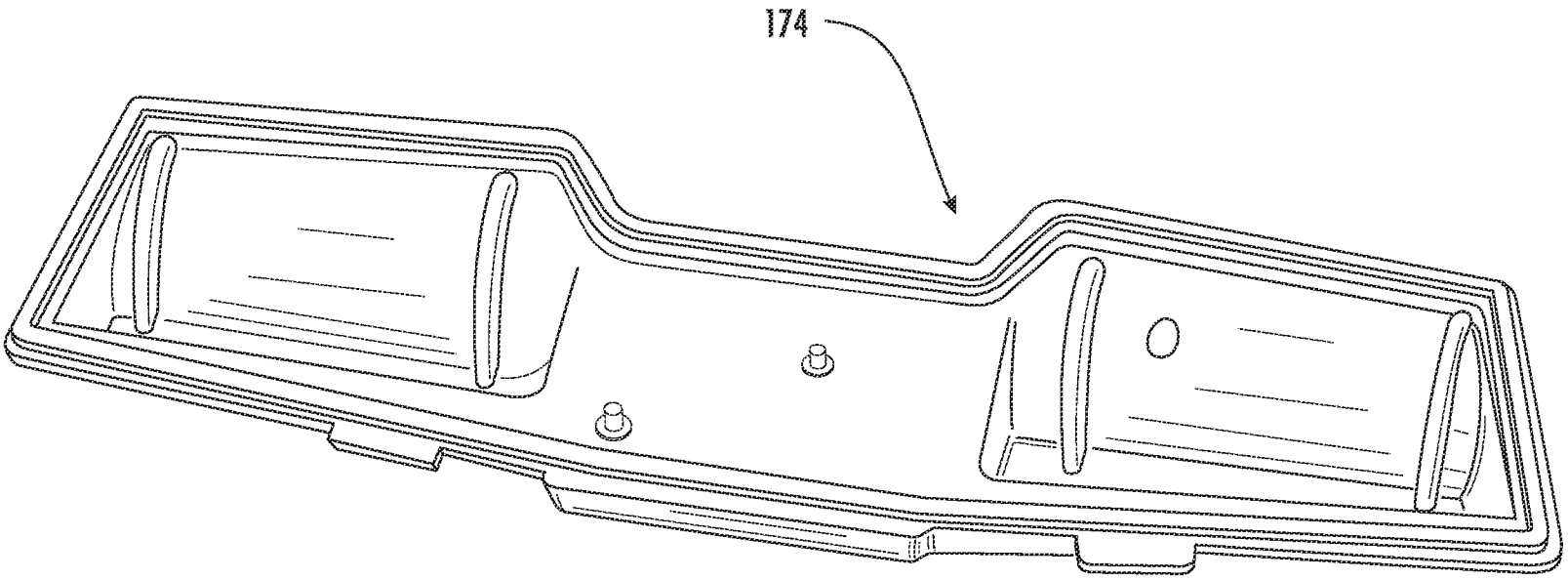
FIG. 10B generally illustrates one embodiment of a top door or cover for use with the bare floor unit of FIG. 10A, consistent with an embodiment of the present disclosure.
Figure 10C:
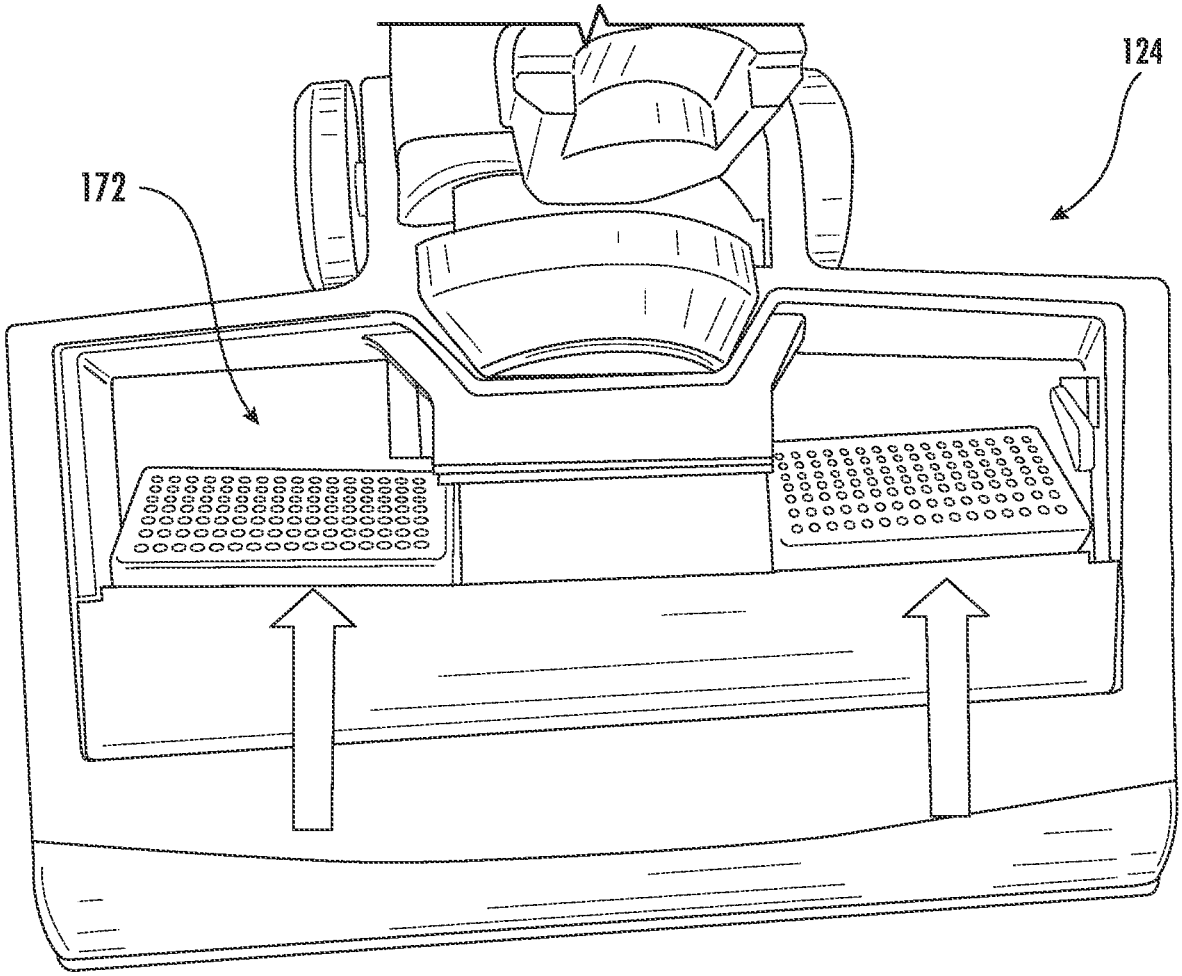
FIG. 10C generally illustrates one embodiment of a filter chamber of the bare floor unit of FIG. 10A, consistent with an embodiment of the present disclosure.

As shown in FIGS. 10A-10C, the multi-mode cleaning apparatus 100 may also include one or more filters 170 (FIG. 10A). In this embodiment, the filters 170 may be located in a filter chamber 172 (FIG. 10C) proximate a top portion of the bare floor unit 124 and within the bare floor air path such that air passes through the filter(s) 170 before passing to the suction motor. A top door or cover 174 (FIG. 10B) may be configured to be removably coupled to the bare floor unit 124 and cover the filter chamber 172 to allow the filters 170 to be removed from the filter chamber 172 and cleaned or replaced. Alternatively (or in addition), one or more filter(s) 170 may be located in the sweeper unit 122 (e.g., see FIG. 3A).

Figure 11A:
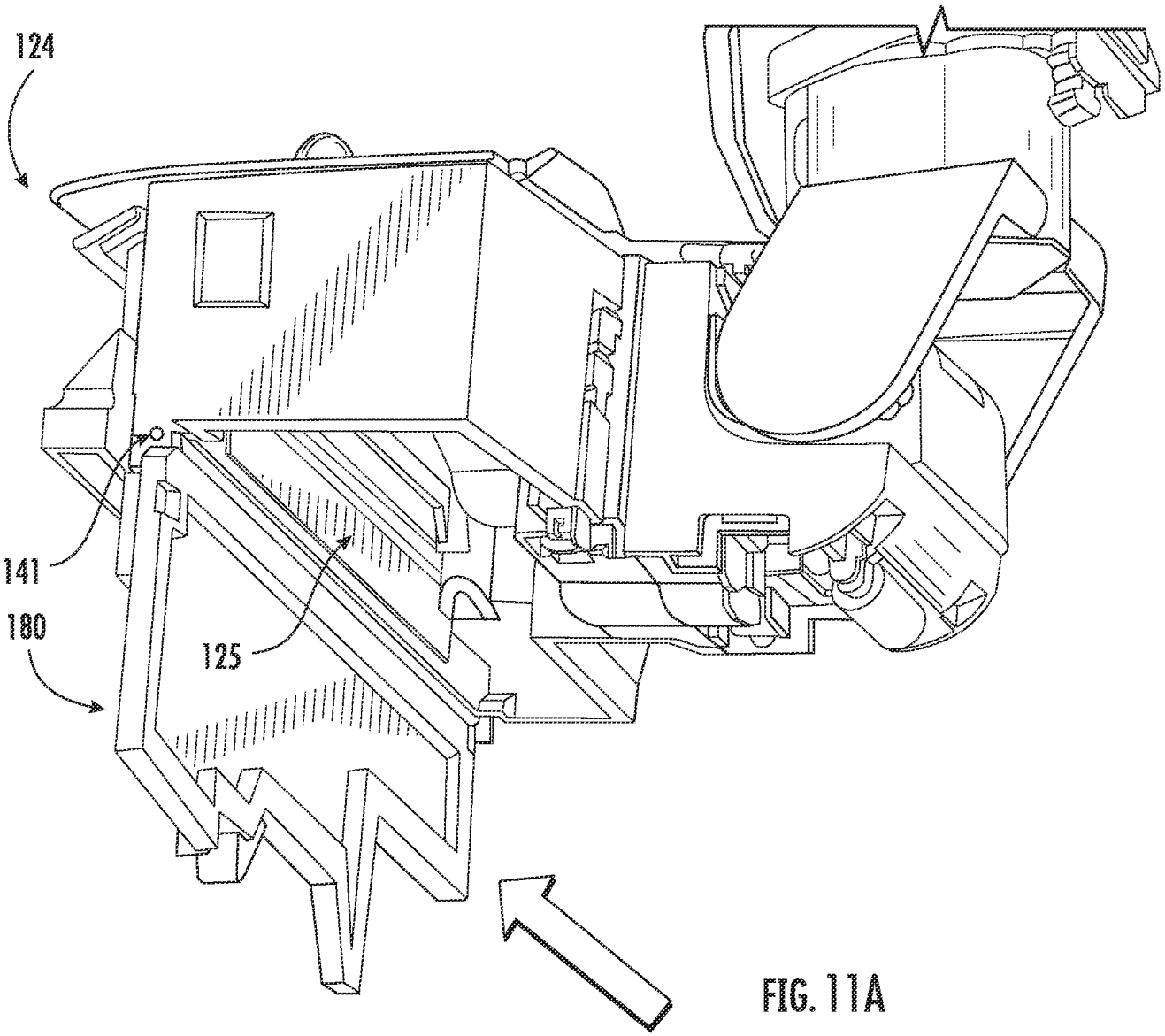
FIG. 11A generally illustrates one embodiment of a bare floor unit of a multi-mode cleaning apparatus including a bottom door in an open position for emptying a dust cup, consistent with an embodiment of the present disclosure.
Figure 11B:
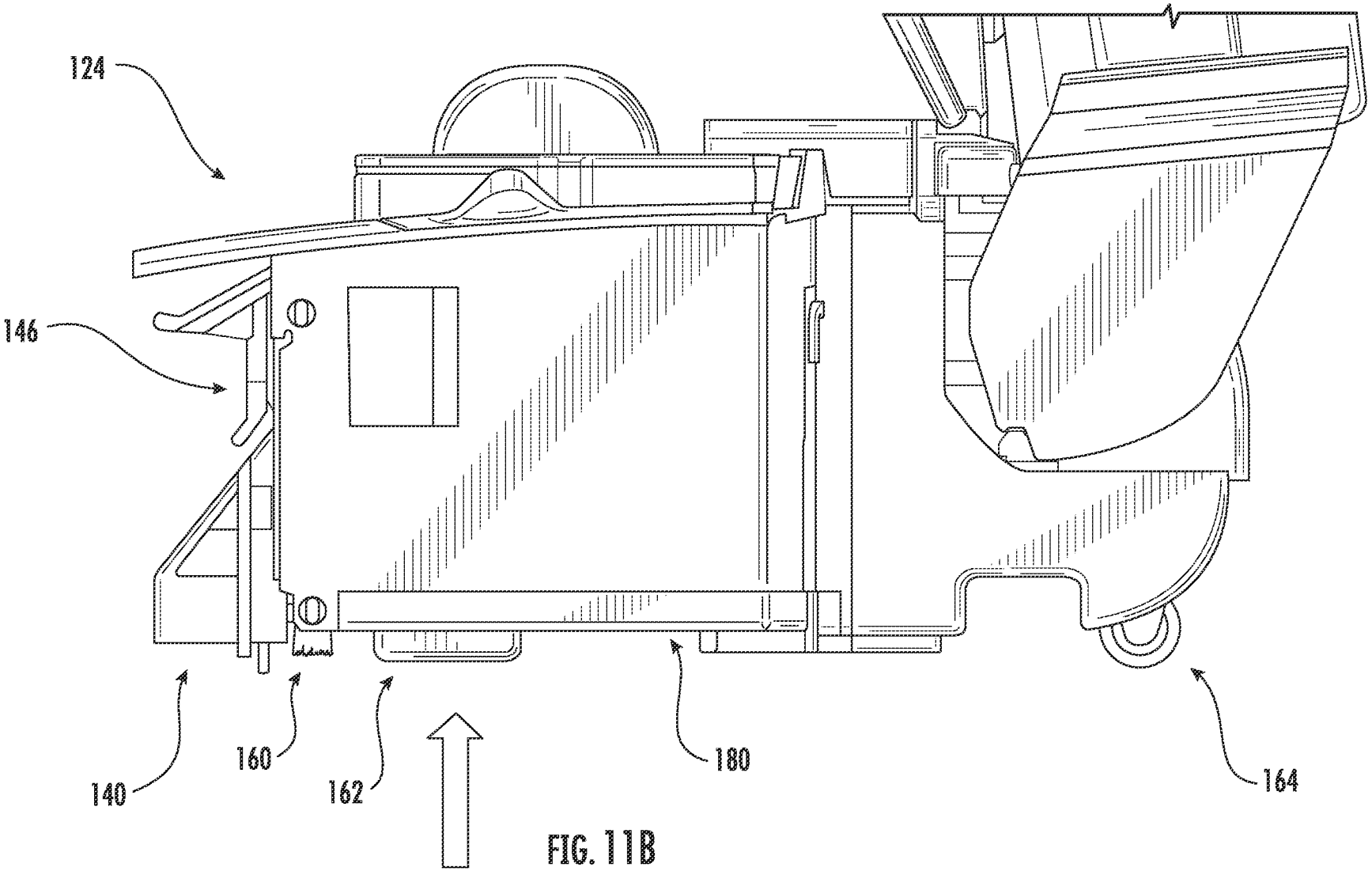
FIG. 11B illustrates the bottom door of the dust cup of the bare floor unit of FIG. 11A in a closed position.

As shown in FIGS. 11A and 11B, an embodiment of the bare floor unit 124 includes a bottom door 180 for emptying the dust cup 125. According to one embodiment, the bottom door 180 may be coupled to the dust cup 125 by way of a hinge or the like 141, though it should be appreciated that the bottom door 180 may be removably coupled to the dust cup 125 in any manner known to those skilled in the art. The bottom door 180 may include a support strip 162 (FIG. 11B), such as a felt strip or other soft material that supports the bare floor unit 124 on the surface being cleaned with relatively low clearance and without using front wheels.

Figure 12A:
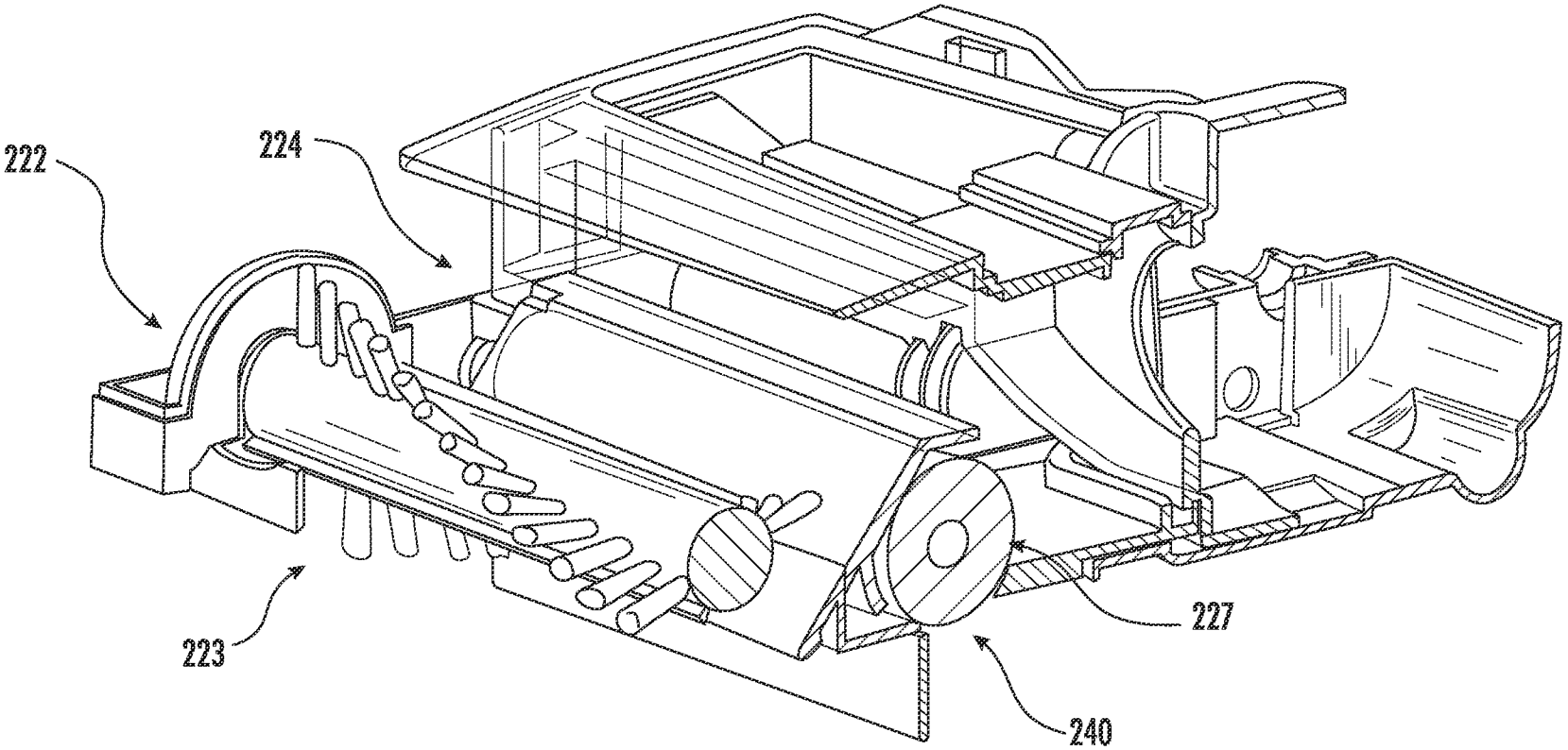
FIG. 12A is a partial cross-sectional view generally illustrating another embodiment of a multi-mode cleaning apparatus including a bare floor unit with a brush roll, consistent with an embodiment of the present disclosure.
Figure 12B:
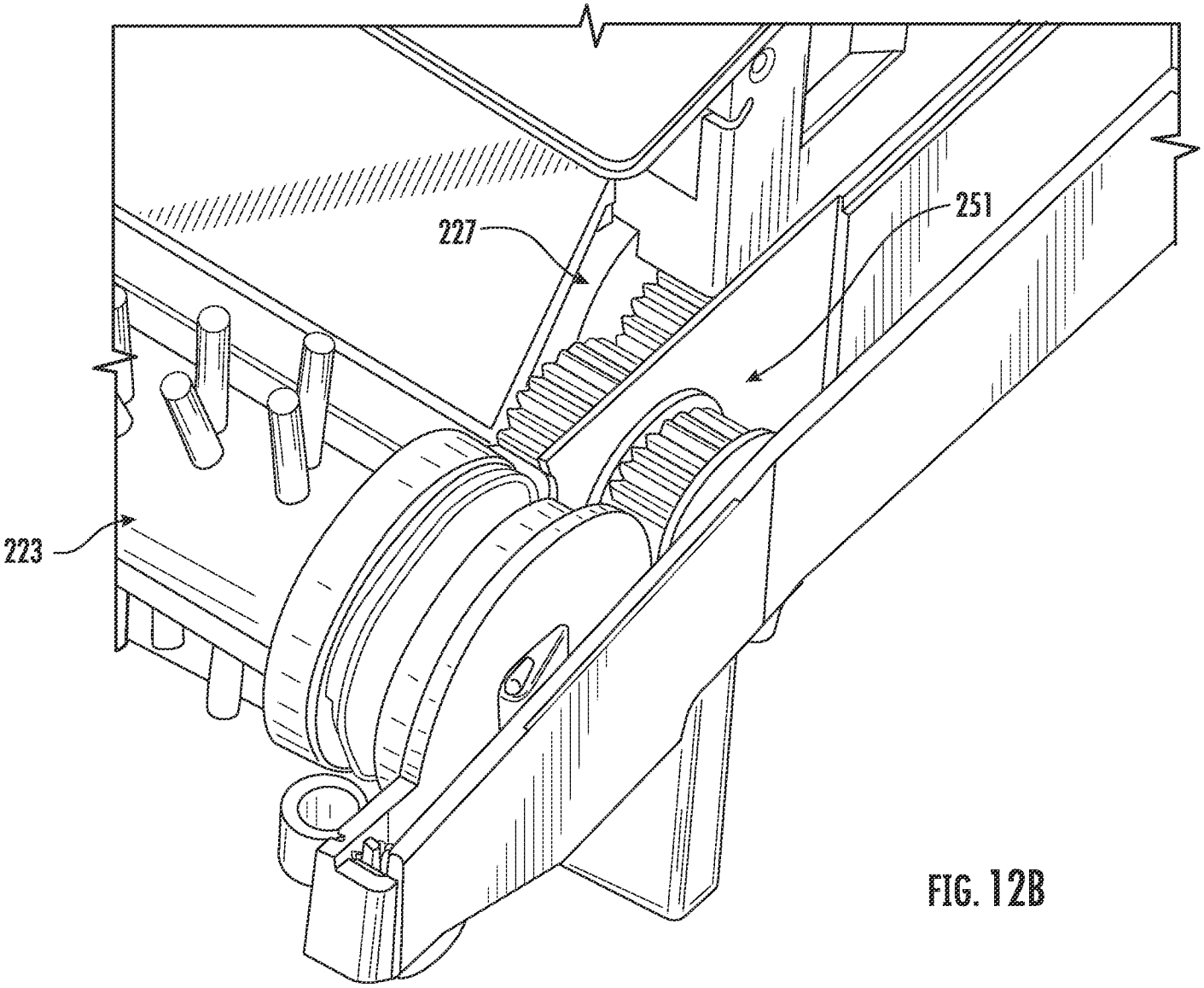
FIG. 12B is another partial view of the multi-mode cleaning apparatus of FIG. 12A.

Referring to FIGS. 12A and 12B, another embodiment of a bare floor unit 224 may include a bare floor brush roll 227 proximate a bare floor inlet 240. The bare floor brush roll 227 may be driven by the same drive mechanism 251 (FIG. 12B) and drive motor as a sweeper brush roll 223 in a sweeper unit 222. The drive mechanism 251 may include, for example, gear and/or belt drive mechanisms. Gear reductions may be used to cause the brush rolls 223, 227 to be driven at different speeds. A safety switch may also be used to turn off the drive motor when the units are connected and disconnected.

The sweeper brush roll 223 and the bare floor brush roll 227 may have different characteristics. For example, the sweeper brush roll 223 may be suitable for carpets and the bare floor brush roll 227 may be suitable for bare or hard floors. One embodiment of the sweeper brush roll 223 may include stiffer nylon bristles (e.g., a diameter of 0.23±0.02 mm) whereas one embodiment of the bare floor brush roll 227 may include less stiff nylon bristles (e.g., a diameter of 0.04±0.02 mm) or other relatively soft material (e.g., fabric, felt, nap or pile).

Figure 13:
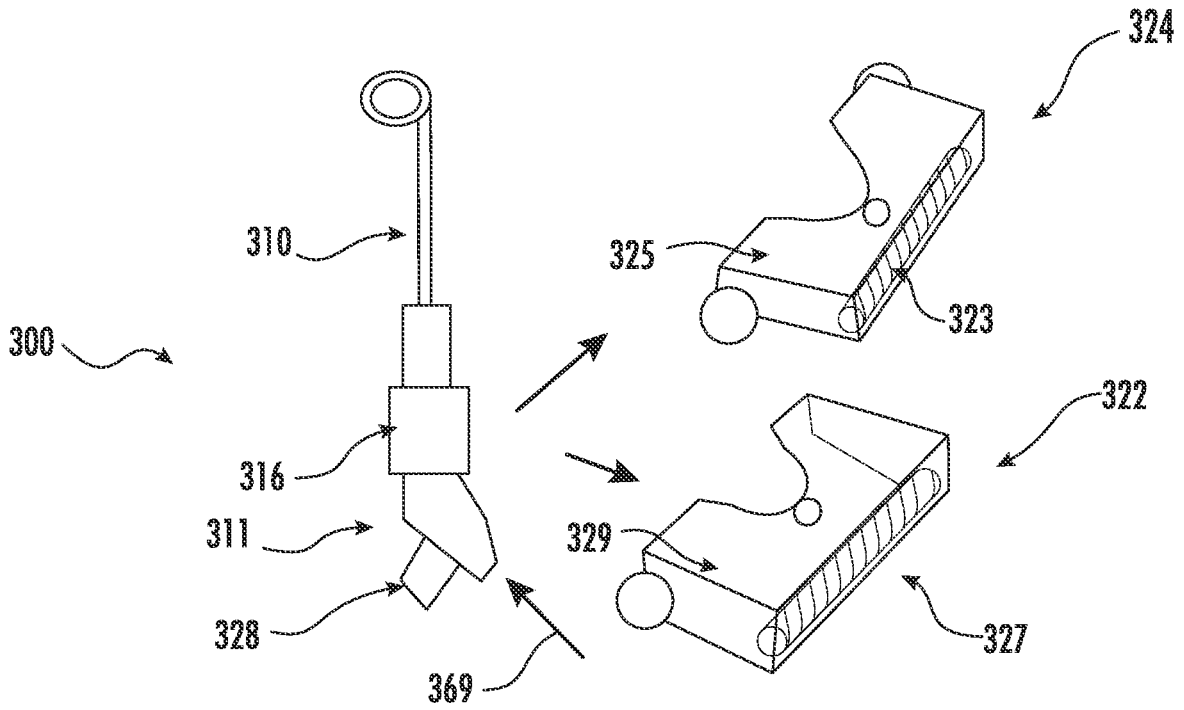
FIG. 13 illustrates a further embodiment of a multi-mode cleaning apparatus including a bare floor unit and a sweeper unit separately attachable to a wand, consistent with an embodiment of the present disclosure.

Referring to FIG. 13, a further embodiment of a multi-mode cleaning apparatus 300 includes a wand 310 and a sweeper unit 322 and a bare floor unit 324 that separately attach to the wand 310. In this embodiment, a suction motor 316 (air flow indicated by arrow 369) and drive motor 328 may be coupled to the wand 310 and operably coupled to each of the units 322, 324 when attached to the wand. The wand 310 may include a base 311 that couples to either of the units 322, 324. Each of the units 322, 324 includes a brush roll 323, 327 proximate an inlet on a bottom portion and a dust cup 325, 329. When the respective units 322, 324 are attached, the respective brush rolls 323, 327 are engaged with the drive motor 328 (e.g., via a gear) and the respective inlets are fluidly coupled to the suction motor.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A multi-mode cleaning apparatus with suction, comprising:

a wand with a handle at a first end;

a bare floor unit coupled to a second end of the wand, the bare floor unit including:

a bare floor inlet proximate a bottom side of the bare floor unit;

a bare floor air path from the bare floor inlet through at least a portion of the bare floor unit; and a dust cup along the air path for holding debris removed from air passing along the air path;

a suction motor fluidly coupled to the air path for drawing air through the air path; and a sweeper unit configured to be coupled to the bare floor unit, the sweeper unit including:

a sweeper inlet proximate a bottom side of the sweeper unit;

a sweeper air path extending from the sweeper inlet and configured to be fluidly coupled to the bare floor air path when the sweeper unit is coupled to the bare floor unit; and a sweeper brush roll located proximate the sweeper inlet for causing debris to move into the sweeper air path and the bare floor air path.

2. The multi-mode cleaning apparatus of claim 1 wherein the bare floor unit further includes a bare floor brush roll proximate the bare floor inlet.

3. The multi-mode cleaning apparatus of claim 1 further comprising a brush roll drive mechanism drivingly engaged with the sweeper brush roll for driving the brush roll.

4. The multi-mode cleaning apparatus of claim 3 wherein the bare floor unit further includes a bare floor brush roll proximate the bare floor inlet, and wherein the brush roll drive mechanism is drivingly engaged with the bare floor brush roll and the sweeper brush roll.

5. The multi-mode cleaning apparatus of claim 3 wherein the brush roll drive mechanism is located in the sweeper unit.

6. The multi-mode cleaning apparatus of claim 1 wherein the suction motor is located in the wand.

7. The multi-mode cleaning apparatus of claim 1 wherein the suction motor is located in the bare floor unit.

8. The multi-mode cleaning apparatus of claim 1 wherein the bare floor unit includes an alternate suction inlet, wherein the alternate suction inlet is closed when the sweeper unit is not coupled to the bare floor unit, and wherein the alternate suction inlet is opened and in fluid communication with the sweeper air path when the sweeper unit is coupled to the bare floor unit.

9. The multi-mode cleaning apparatus of claim 8 wherein the bare floor inlet is closed when the sweeper unit is coupled to the bare floor unit.

10. The multi-mode cleaning apparatus of claim 8 wherein the bare floor unit includes a diverter door for covering the alternate suction inlet, wherein the diverter door is in a closed position when the sweeper unit is not coupled to the bare floor unit, and wherein the diverter door is in an opened position when the sweeper unit is coupled to the bare floor unit.

11. The multi-mode cleaning apparatus of claim 1 wherein the sweeper unit includes a bare floor unit receiving region for receiving the bare floor unit when coupled.

12. The multi-mode cleaning apparatus of claim 1 further including a release mechanism to release the bare floor unit when coupled to the sweeper unit.

13. The multi-mode cleaning apparatus of claim 12 wherein the release mechanism includes a foot pedal.

14. The multi-mode cleaning apparatus of claim 1 wherein the bare floor unit further includes at least one filter in the flow path after the dust cup for filtering air passing through the flow path toward the suction motor.

15. The multi-mode cleaning apparatus of claim 14 wherein the at least one filter is located in a filter chamber proximate a top portion of the bare floor unit, and wherein the bare floor unit further includes a top cover over the filter chamber.

16. The multi-mode cleaning apparatus of claim 1 wherein the bare floor unit further includes a pivoting bottom door for emptying the dust cup.

17. The multi-mode cleaning apparatus of claim 1 wherein the bare floor unit further includes a felt strip or other soft fabric or textile material on a bottom side for contacting the floor when used without the sweeper unit.

18. A multi-mode cleaning apparatus with suction, comprising:

a wand with a handle at a first end and a base at a second end;

a suction motor coupled to the wand;

a brush roll drive motor coupled to the base of the wand;

a bare floor unit configured to be coupled to the base of the wand, the bare floor unit including a bare floor inlet at a bottom side, a bare floor air path extending from the bare floor inlet and configured to be fluidly coupled to the suction motor when the bare floor unit is coupled to the base of the wand, a dust cup located along the bare floor air path for holding debris, and a bare floor brush roll proximate the bare floor inlet and configured to be drivingly engaged with the brush roll drive motor when the bare floor unit is coupled to the base of the wand; and a sweeper unit configured to be coupled to the base of the wand, the sweeper unit including a sweeper inlet at a bottom side, a sweeper air path extending from the sweeper inlet and configured to be fluidly coupled to the suction motor when the sweeper unit is coupled to the base of the wand, a dust cup located along the sweeper air path for holding debris, and a sweeper brush roll proximate the bare floor inlet and configured to be drivingly engaged with the brush roll drive motor when the sweeper unit is coupled to the base of the wand, wherein the sweeper brush roll and the bare floor brush roll have different characteristics.

19. The multi-mode cleaning apparatus of claim 18 wherein the sweeper brush roll has stiffer bristles than the bare floor brush roll.

20. The multi-mode cleaning apparatus of claim 18 further including at least one drive gear coupled to the base of the wand and coupled to the brush roll drive motor, and wherein the bare floor unit and the sweeper unit each include at least one brush roll gear coupled to the respective brush rolls and configured to engage the drive gear when coupled to the base of the wand.

21. A multi-mode cleaning apparatus with suction, comprising:

a wand with a handle;

a suction motor for providing suction;

a bare floor unit configured to be movable by the wand and fluidly coupled to the suction motor, wherein the bare floor unit is configured for use in a suction only mode; and a sweeper unit configured to be movable by the wand and fluidly coupled to the suction motor, the sweeper unit including a rotatable brush roll, wherein the sweeper unit is configured for use in a brush roll only mode or a suction and brush roll mode.

22. The multi-mode cleaning apparatus of claim 21 further including a switch configured to select between the brush roll only mode and the suction and brush roll mode.

* * * * *